US006380917B2

(12) United States Patent
Matsueda et al.

(10) Patent No.: US 6,380,917 B2
(45) **Date of Patent: *Apr. 30, 2002**

(54) DRIVING CIRCUIT OF ELECTRO-OPTICAL DEVICE, DRIVING METHOD FOR ELECTRO-OPTICAL DEVICE, AND ELECTRO-OPTICAL DEVICE AND ELECTRONIC EQUIPMENT EMPLOYING THE ELECTRO-OPTICAL DEVICE

(75) Inventors: Yojiro Matsueda, Chino; Tokuroh Ozawa, Suwa, both of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/202,517

(22) PCT Filed: Apr. 16, 1998

(86) PCT No.: PCT/JP98/01729

§ 371 Date: Dec. 17, 1998

§ 102(e) Date: Dec. 17, 1998

(87) PCT Pub. No.: WO98/48317

PCT Pub. Date: Oct. 29, 1998

(30) Foreign Application Priority Data

Apr. 18, 1997 (JP) ..... 9-102293

(51) Int. Cl.[7] ..... G09G 3/36

(52) U.S. Cl. ..... 345/89; 345/211; 345/210; 345/95

(58) Field of Search ..... 345/87, 88, 89, 345/98, 99, 100, 147, 204, 205, 211, 94, 95, 208, 210

(56) References Cited

U.S. PATENT DOCUMENTS

| | | | |
|---|---|---|---|
| 4,937,578 | A | 6/1990 | Shioda |
| 5,017,914 | A | 5/1991 | Uchida et al. |
| 5,396,123 | A | 3/1995 | Minamizaki |

(List continued on next page.)

FOREIGN PATENT DOCUMENTS

| | | | |
|---|---|---|---|
| EP | 0-483-972 | A | 9/1991 |
| EP | 0 601 713 | A | 6/1994 |
| FR | 2-698-202 | A | 11/1992 |
| GB | 2-217-128 | A | 10/1989 |

(List continued on next page.)

OTHER PUBLICATIONS

Matsueda, Y., et al. "Low–Temperature Poly–Si TFT–LCD with Integrated 6–bit Digital Data Drivers", *SID 96 Digest*, pp. 21–24.

Electronics and Communications in Japan, Part II: Electronics, "Poly–Si TFT and Driver Integration Technology," H. Ohshima et al.; vol. 77, No. 7, Jul. 1994,New York, pp. 46–54.

(List continued on next page.)

*Primary Examiner*—Xiao Wu
(74) *Attorney, Agent, or Firm*—Oliff & Berridge, PLC

(57) ABSTRACT

A driving circuit of an electro-optical device such as a liquid crystal device is compatible with digital image signals and implements a DA converting function and a γ correcting function by a relatively simple and small-scale circuit configuration. The driving circuit of the liquid crystal device is provided with a DAC 3 for issuing a voltage signal $V_C$ corresponding to N bits of digital image data $D_A$ that indicate a gray scale value to a signal line of the liquid crystal device. Depending on whether the value of a most significant bit is "0" or "1," the DAC 3 brings the output driving voltage characteristic close to the optical characteristics of the liquid crystal device according to the a pair of first or second reference voltages so as to make a γ correction.

33 Claims, 17 Drawing Sheets

U.S. PATENT DOCUMENTS

| | | | | |
|---|---|---|---|---|
| 5,453,757 | A | | 9/1995 | Date et al. |
| 5,648,791 | A | * | 7/1997 | Date et al. ..... 345/89 |
| 5,680,149 | A | | 10/1997 | Koyama et al. |
| 5,686,936 | A | | 11/1997 | Maekawa et al. |
| 5,764,207 | A | | 6/1998 | Maekawa et al. |
| 5,796,384 | A | * | 8/1998 | Kim ..... 345/147 |
| 6,061,046 | A | * | 5/2000 | An ..... 345/98 |

FOREIGN PATENT DOCUMENTS

| | | |
|---|---|---|
| JP | A 57-52228 | 3/1982 |
| JP | A 58-97918 | 6/1983 |
| JP | A-59-107628 | 6/1984 |
| JP | A-62-131233 | 6/1987 |
| JP | A-63-52121 | 3/1988 |
| JP | A-01-009375 | 1/1989 |
| JP | A-1-233919 | 9/1989 |
| JP | A-2-154292 | 6/1990 |
| JP | A-2-226975 | 9/1990 |
| JP | A-2-245794 | 10/1990 |
| JP | A-3-190429 | 8/1991 |
| JP | A-3-214818 | 9/1991 |
| JP | A-4-46386 | 2/1992 |
| JP | A-4-195189 | 7/1992 |
| JP | A-5-94159 | 4/1993 |
| JP | A-5-100635 | 4/1993 |
| JP | A-5-102857 | 4/1993 |
| JP | A 5-303080 | 11/1993 |
| JP | A 6-59648 | 3/1994 |
| JP | A-6-75543 | 3/1994 |
| JP | A-6-178238 | 6/1994 |
| JP | A-6-222741 | 8/1994 |
| JP | A 6-268522 | 9/1994 |
| JP | A2 7191303 | 7/1995 |
| JP | A-7-261714 | 10/1995 |
| JP | A-7-295520 | 11/1995 |
| JP | A-7-295521 | 11/1995 |
| JP | A-8-227283 | 9/1996 |
| JP | A-8-234697 | 9/1996 |
| JP | A-8-286641 | 11/1996 |
| JP | A-9-73283 | 3/1997 |
| JP | A-9-179530 | 7/1997 |
| WO | WO A1 9503629 | 2/1995 |

OTHER PUBLICATIONS

Review of the Electrical Communication Laboratories, "A 10–In. Diagonal Active Matrix Monochrome Liquid–Crystal Display," S. Sakai et al.; vol. 36, No. 4, Jul. 1988, Tokyo, pp. 395–401.

Nikkei Business Publications, Inc., "Driver LSI Problems Solved by Low Voltage Single Power Supply", *Flat Panel Display 1991* , Nov. 26, 1990, pp. 168–172.

Nikkei Business Publications, Inc., "A 13–inch EWS High–Definition TFT Liquid Crystal Panel with Improved Picture Quality by Means of Dot Inversion Driving", *Flat Panel Display 1993*, Dec. 10, 1992, pp. 120–123.

* cited by examiner (A)

(B)

DRIVING CIRCUIT OF ELECTRO-OPTICAL DEVICE, DRIVING METHOD FOR ELECTRO-OPTICAL DEVICE, AND ELECTRO-OPTICAL DEVICE AND ELECTRONIC EQUIPMENT EMPLOYING THE ELECTRO-OPTICAL DEVICE

BACKGROUND OF THE INVENTION

1. Field of Invention

The present invention relates to a technical field of a driving circuit and a driving method for driving an electro-optical device such as a liquid crystal device, the electro-optical device, and electronic equipment employing the electro-optical device and, more particularly, to a driving circuit and a driving method of an electro-optical device that receives a digital image signal and has a DA (Digital to Analog) converting function and a γ correcting function for an electro-optical device, the electro-optical device, and electronic equipment using the electro-optical device.

2. Description of Related Art

Hitherto, as a driving circuit for driving a liquid crystal device, which is an example of one type of electro-optical device, there is available, for example, a so-called digital driving circuit configured to receive digital image data indicating an arbitrary step of gray scale among a plurality of steps of gray scale, generate analog image data having a driving voltage corresponding to the step of gray scale, and supply the generated analog image data to a signal line of the liquid crystal device. Such a driving circuit is usually provided with a digital-to-analog converter (hereinafter referred to as "DA converter" or "DAC" as necessary) for converting digital image data to analog image data; it is configured to latch the digital image data, which has been input via a digital interface, by a latching circuit, then subject it to analog conversion through a switched capacitor type DA converter (hereinafter referred to as "SC-DAC" (Switched Capacitor—DAC: switch control capacity type DAC) as necessary), a DAC composed of a resistance ladder circuit or the like.

In a liquid crystal device or the like, the changes in optical characteristics (transmittance, optical density, luminance or the like) with respect to the changes in the driving voltage (or a voltage applied to the liquid crystal) are generally nonlinear according to the saturation characteristic or threshold value characteristic that the liquid crystal or the like has and they exhibit a so-called "γ characteristic." Hence, this type of driving circuit is normally provided with γ correcting means for making a correction on digital image data in a stage preceding the latching circuit.

The γ correcting means, for example, carries out γ correction on 6-bit digital image data $D_A$ by referring to a table stored in RAM or ROM so as to convert it into 8-bit digital image data $D_B$ (Dγ1, Dγ2, . . . , Dγ8). The processing by the γ correcting means is implemented, considering the input/output characteristics of the DAC and the characteristic of the transmittance of liquid crystal pixels with respect to the voltage applied to a signal line (characteristics of transmittance vs. the voltage applied to liquid crystal). The transmittance characteristic of the liquid crystal pixels refers to the characteristic of changes in the transmittance of light obtained by transmitting through a liquid crystal layer with respect to the voltage applied to the liquid crystal layer held between a pair of substrates (transmitting through polarizer if they are disposed outside the substrates as necessary).

On the other hand, the aforesaid SC-DAC is constituted by a plurality of capacitive elements disposed in parallel.

The respective capacitive elements have binary ratios of, for example, $2^0C$, $2C$, $2^2C$, $2^4C$ and so on. Using these capacitive elements, a pair of reference voltages are subjected to voltage division or the like (charge share) thereby to output analog image data having a driving voltage that changes according to the changes in the gray scale of image data $D_B$. The DAC such as the SC-DAC configured as described above is connected to a signal line of a liquid crystal device or the like; a buffer circuit or the like is provided between the output terminal of the DAC and the signal line so as to protect the output voltage from the influences of the parasitic capacitance of the signal line.

As set forth above, the driving circuit causes a voltage corresponding to the digital image data $D_B$ to be applied to the respective signal lines of a liquid crystal device or the like.

Graph (A) on the left in FIG. 21 shows the relationship between the decimal values of image data $D_A$ and output voltage Vc of the DAC; graph (B) on the right in FIG. 21 shows the relationship between transmittance $S_{LP}$ of liquid crystal pixels and voltage $V_{LP}$ applied to the signal line (the axis of the transmittance is based on the logarithm). At the center in FIG. 21, the binary values of 8-bit digital image data $D_B$ are given between the two graphs (A) and (B).

In graph (B) on the right in FIG. 21, $2^6$ pieces of 8-bit data capable of distinguishably representing the transmittance characteristic of the liquid crystal pixels are selected among $2^8$ pieces of 8-bit data obtained from the 8-bit input data to make the γ correction and the selected pieces of data are tabulated. And when 6-bit image data $D_A$ is input, the γ correcting means converts it into 8-bit data $D_B$ according to the table and outputs it to the DAC. More specifically, image data $D_A$ is represented in 64-step gray scale; therefore, the foregoing conversion is carried out so that the data $D_A$ for 64 steps of gray scale may be specified among the 256 steps of gray scale that can be represented by image data $D_B$ in order to provide even changing ratio of the transmittance in the liquid crystal when image data $D_A$ expressed in the 64-step gray scale is changed.

Thus, FIG. 21 illustrates the correspondence relationship between the 6-bit image data $D_A$ and the 8-bit image data $D_B$ and output voltage Vc (equivalent to $V_{LP}$) of the DAC.

SUMMARY OF THE INVENTION

The foregoing conventional driving circuit, however, requires γ correcting means and RAM or ROM or the like for storing the conversion table for the γ correction which are provided in the stage preceding the latching circuit in order to make γ correction. These components, therefore, provide obstacles in an attempt to reduce the size of the driving circuit. It would be possible to make up the DAC by using many amplifiers so as to provide it with the γ correcting function without using the aforesaid SC-DAC. This, however, would pose such a problem as a more complicated circuit. In addition, forming operational amplifiers on a glass substrate tends to cause more variations in operating characteristics to occur.

Accordingly, it is an object of the present invention to provide a driving circuit of an electro-optical device that is compatible with digital image signals and has a relatively simple and small-scale circuit configuration to provide a DA converting function and a γ correcting function (or an auxiliary function for making a γ correction), the electro-optical device, and electronic equipment employing the electro-optical device.

To this end, according to one aspect of the present invention, there is provided a driving circuit of an electro-optical device that supplies an analog image signal, which has a driving voltage corresponding to an arbitrary step of gray scale among $2^N$ (where N is a natural number) steps of gray scale, to a signal line of an electro-optical device in which the changes in the optical characteristics with respect to the changes in the driving voltage are nonlinear; the driving circuit of the electro-optical device being provided with: an input interface to which an N-bit digital image signal indicative of the arbitrary step of gray scale is applied; and a digital-to-analog converter that generates a voltage within a range of a pair of first reference voltages according to the bit value of the foregoing digital image signal to produce the driving voltage within a first driving voltage range corresponding to the step of gray scale of the digital image signal so that the changes in the driving voltage with respect to the changes in the step of gray scale of the digital image signal are nonlinear if the applied digital image signal indicates a step of gray scale from a first to m−1th (where "m" is a natural number and $1<m\leqq 2^N$), and generates a voltage within a range of a pair of second reference voltages according to the bit value of the foregoing digital image signal to produce the driving voltage that corresponds to the step of gray scale of the digital image signal and also lies within a second driving voltage range adjacent to the first driving voltage range so that the changes in the driving voltage with respect to the changes in the gray scale of the digital image signal are nonlinear if the digital image signal indicates a step of gray scale from an m-th to $2^N$-th gray scale, and supplies the analog image signal having the generated driving voltage to the signal line.

According to another aspect of the present invention, there is provided a driving method of an electro-optical device having a digital-to-analog converter that supplies an analog image signal having a driving voltage corresponding to an arbitrary step of gray scale among $2^N$ (where N is a natural number) steps of gray scale to a signal line of the electro-optical device in which the optical characteristics thereof change nonlinearly with respect to the changes in the driving voltage, the driving method including the steps of:

inputting an N-bit digital image signal indicative of the arbitrary step of gray scale to the digital-to-analog converter;

generating, by the digital-to-analog converter, a voltage within the range of a pair of first reference voltages according to the bit value of the foregoing digital image signal to produce the driving voltage within a first driving voltage range corresponding to the step of gray scale of the digital image signal so that the changes in the driving voltage with respect to the changes in the step of gray scale of the digital image signal are nonlinear if the input digital image signal indicates a step of gray scale from a first to m−1th (where "m" is a natural number and $1<m\leqq 2^N$;

generating, by the digital-to-analog converter, a voltage within the range of a pair of second reference voltages according to the bit value of the foregoing digital image signal to produce the driving voltage that corresponds to the step of gray scale of the digital image signal and also lies within a second driving voltage range adjacent to the first driving voltage range so that the changes in the driving voltage with respect to the changes in the gray scale of the digital image signal are nonlinear if the digital image signal indicates a step of gray scale from the m-th to $2^N$-th; and supplying the analog image signal having the generated driving voltage to the signal line.

According to the driving circuit and driving method of an electro-optical device, the N-bit digital image signal indicating an arbitrary step of gray scale is supplied first via an input interface. Then, if the supplied digital image signal indicates a step of gray scale from the first to the m−1th, a voltage within the range of the pair of first reference voltages is selectively generated according to the bit value of the digital image signal by the digital-to-analog converter so as to produce the driving voltage that lies within the first driving voltage range. On the other hand, if the digital image signal indicates a step of gray scale from the m-th to the $2^N$-th, then a voltage within the range of the pair of the second reference voltages is selectively generated according to the bit value of the digital image signal by the digital-to-analog converter so as to produce the driving voltage that lies within the second driving voltage range. And the analog image signal having the driving voltage thus generated is supplied to the signal line to drive the electro-optical device. At this time, the changes in the optical characteristics with respect to the changes in the driving voltage in the electro-optical device are nonlinear, and the changes in the driving voltage with respect to the changes in the gray scale of the digital image signal in the digital-to-analog converter are also nonlinear.

In general, the changes in the driving voltage (output) in response to the step of gray scale (input) in the digital-to-analog converter that divides the reference voltages become almost linear if the step of gray scale is low, whereas they tend to be saturated and exhibit, for example, asymptote-like nonlinearity as the step of gray scale becomes higher because of the parasitic capacitance of the signal line on the output side. On the other hand, there are cases where the changes in the optical characteristics (output) with respect to the driving voltage (input) in the electro-optical device show an S-shaped nonlinearity having its inflection point located at around the center thereof due to the saturation characteristic that most electro-optical devices have, a threshold value characteristic or the like. For instance, in the case of a liquid crystal device, the changes in the transmittance (an example of the optical characteristic) with respect to applied voltage in liquid crystal pixels exhibit the saturation characteristic in the areas in the vicinity of a maximum applied voltage and a minimum applied voltage, respectively; therefore, the changes show the S-shaped nonlinearity having its inflection point located at around the central voltage.

Accordingly, if a single reference voltage is divided in the digital-to-analog converter, it would be difficult to correct the nonlinearity of the optical characteristics (e.g. the S-shaped nonlinearity having its inflection point located at around the center thereof) in the electro-optical device by making use of the nonlinearity of the driving voltage (e.g. asymptote nonlinearity) because of the non-similarity between the two. According to the present invention, however, the nonlinearity of the driving voltage in the first driving voltage range obtained by generating the voltage within the range of the first reference voltage can be combined with the nonlinearity of the driving voltage in the second driving voltage range obtained by generating the voltage within the range of the second reference voltage so as to make the nonlinearity of the driving voltage over the entire first and second driving voltage ranges similar to a certain extent to the nonlinearity of the optical characteristics (in other words, it is possible to provide both nonlinearities with a change trend that is similar to a certain extent). In particular, by setting the voltage so that the polarities of the pair of the first reference voltages and the polarities of the pair of the second reference voltages are opposite in relation to the digital-to-analog converter, the driving voltage with respect to the gray scale can be inflected at the boundary of the first and second driving voltage ranges.

Thus, it is possible to drive the electro-optical device by using a digital image signal as an input, and to correct the nonlinearity of the optical characteristics of the electro-optical device by making use of the nonlinearity of the driving voltage of the digital-to-analog converter according to the degree of the similarity between these nonlinearities. This means that the γ correction for the electro-optical device can be made by using the digital-to-analog converter.

According to the present invention as set forth above, it is not required to separately provide the γ correcting means in a stage preceding the digital-to-analog converter, which was required in the prior art. As an alternative, however, such a γ correcting means may be separately provided to make a γ correction in a first stage, and a γ correction in a second stage may be made by the foregoing digital-to-analog converter in accordance with the present invention. In this case, a rough γ correction may be made in one of these two stages, then a fine γ correction may be made in the other stage.

In a mode of the driving circuit in accordance with the present invention described above, the voltage polarities of the pair of the first reference voltages and the voltage polarities of the pair of the second reference voltages supplied to the digital-to-analog converter are set to be opposite from each other so that the changes in the driving voltage corresponding to the changes in the gray scale have the inflection points between the first and second driving voltage ranges.

According to this embodiment, the optical characteristics in the electro-optical device exhibit the S-shaped nonlinearity having the inflection point between the first and second driving voltage ranges. Meanwhile, the first and second reference voltages, in which the voltage polarities of the reference voltages are opposite to each other, are supplied to the digital-to-analog converter; hence, the driving voltage in the digital-to-analog converter also exhibits the S-shaped nonlinearity having the inflection point located between the first and second driving voltage ranges. Further, there is the change trend corresponding to the change in the S-shaped nonlinearity of the optical characteristics, thus making it possible to achieve a high level of correction of the nonlinearity of the optical characteristics in the electro-optical device by utilizing the nonlinearity of the driving voltage over the entire first and second driving voltage ranges.

In another embodiment of the driving circuit in accordance with the present invention described above, the value of "m" is equal to $2^{N-1}$ and lower N−1 bits of the digital image signal are selectively input to the digital-to-analog converter as they are or after being inverted according to the value of the most significant bit of the digital image signal. The digital-to-analog converter generates a voltage in the range of the first reference voltage if the lower N−1 bits are input thereto as they are, and it generates a voltage in the range of the second reference voltage if the lower N−1 bits are inverted before being input thereto.

According to the embodiment, the value of "m" is equal to $2^{N-1}$ In other words, the first half or the latter half of the $2^N$ steps of gray scale corresponds to the driving voltage in the first driving voltage range and the other half corresponds to the driving voltage in the second driving voltage range. In this case, lower N−1 bits of the digital image signal are selectively input to the digital-to-analog converter as they are or after being inverted, depending upon the binary value (i.e. depending upon whether the value is "0" or "1") of the most significant bit of the digital image signal. The digital-to-analog converter generates a voltage in the range of the first reference voltage to generate the driving voltage in the first driving voltage range if the lower N−1 bits are input thereto as they are. On the other hand, the digital-to-analog converter generates a voltage in the range of the second reference voltage to generate the driving voltage in the second driving voltage range if the lower N−1 bits are inverted before being input thereto. Hence, only one N−1 bit digital-to-analog converter is required as the digital-to-analog converter for converting N-bit digital image signals, making it extremely advantageous from the viewpoint of the composition of the device.

In this embodiment, a selective inverting circuit for selectively inverting the lower N−1 bits depending upon the value of the most significant bit may be further provided between the interface and the digital-to-analog converter.

In such a configuration, when a digital image signal is input via the interface, the selective inverting circuit selectively inverts the lower N−1 bits according to the value of the most significant bit. And the selectively inverted lower N−1 bits are input to the digital-to-analog converter which generates a voltage in the range of the first or second reference voltage so as to generate a driving voltage in the first or second driving voltage range.

Still another embodiment of the driving circuit in accordance with the present invention is further provided with a selective voltage supply circuit for selectively supplying either the first or second reference voltage to the digital-to-analog converter according to the value of the most significant bit of the digital image signal.

According to this embodiment, depending upon the value of the most significant bit of the digital image signal, the selective voltage supply circuit selectively supplies the first or second reference voltage to the digital-to-analog converter. Then, the digital-to-analog converter generates a voltage in the range of the first or second reference voltage selectively supplied so as to generate a driving voltage in the first or second driving voltage range. Thus, the portion of the digital-to-analog converter for selectively generating a voltage in the range of the first reference voltage can be commonly used as the portion of the digital-to-analog converter for selectively generating a voltage in the range of the second reference voltage, making it advantageous from the viewpoint of the composition of the device.

Yet another embodiment of the driving circuit in accordance with the present invention is further provided with, as the digital-to-analog converter, a switched capacitor type digital-to-analog converter adapted to generate the voltages in the ranges of the first and second reference voltages, respectively, by means of charging a plurality of capacitors.

According to this embodiment, the voltages in the ranges of the first and second reference voltages are generated by the plurality of capacitors of the switched capacitor type digital-to-analog converter. This makes it possible to generate driving voltages by relatively reliable, accurate voltage selection by using a relatively simple composition.

In this embodiment, the first reference voltage may be composed of a pair of voltages that enable a voltage in the first driving voltage range to be selectively generated, and the second reference voltage may be composed of a pair of voltages that enable a voltage in the second driving voltage range to be selectively generated.

Such a composition allows a voltage in the range of a pair of the first reference voltages to be generated by the plurality of capacitors of the switched capacitor type digital-to-analog converter, thereby providing a discrete driving voltage that lies in the first driving voltage range. On the other hand, a voltage in the range of a pair of the second reference voltages is generated to provide a discrete driving voltage that lies in the second driving voltage range. Hence, desired first and second driving voltage ranges can be obtained according to the setting of the pair of the first reference voltages and the setting of the pair of the second reference voltages, and the gap between these ranges can be also reduced.

In this case, the value of the foregoing "m" is equal to $2^{N-1}$, and the composition may be such that the lower N−1 bits of the digital image signal are selectively input to the switched capacitor type digital-to-analog converter as they are or inverted before being input thereto according to the value of the most significant bit of the digital image signal, and the switched capacitor type digital-to-analog converter generates a voltage in the range of the first reference voltage if the lower N−1 bits are input thereto as they are, and it generates a voltage in the range of the second reference voltage if the lower N−1 bits are inverted before being input thereto.

According to the configuration set forth above, the value of "m" is equal to $2^{N-1}$, and the first half or the latter half of the $2^N$ steps of gray scale corresponds to the driving voltage in the first driving voltage range and the other half corresponds to the driving voltage in the second driving voltage range. In this case, lower N−1 bits of the digital image signal are selectively input to the switched capacitor type digital-to-analog converter as they are or after being inverted depending upon the value of the most significant bit of the digital image signal. And the switched capacitor type digital-to-analog converter generates a voltage in the range of the first reference voltage to generate a driving voltage in the first driving voltage range if the lower N−1 bits are input thereto as they are. On the other hand, the switched capacitor type digital-to-analog converter generates a voltage in the range of the second reference voltage to generate a driving voltage in the second driving voltage range if the lower N−1 bits are inverted before being input thereto. Hence, only one N−1 bit switched capacitor type digital-to-analog converter is required as the SC-DAC to convert an N-bit digital image signal, making it extremely advantageous from the viewpoint of the composition of the device.

In this case, the switched capacitor type digital-to-analog converter may be further provided with: a first through N−1th capacitive elements respectively having a pair of opposed electrodes, wherein one of the paired first reference voltages or one of the paired second reference voltages is selectively applied to one of the paired opposed electrodes according to the binary value of the most significant bit; a capacitive element resetting circuit for short-circuiting the pair of opposed electrodes in each of the first through N−1th capacitive elements so as to discharge electric charges; a signal line potential resetting circuit for selectively resetting the voltage of the signal line to the other of the paired first reference voltages or the other of the paired second reference voltages according to the binary value of the most significant bit; and a selective switching circuit including a first through N−1th switches that selectively connect the first through N−1th capacitive elements to the signal lines, respectively, according to the values of the lower N−1 bits after the discharge by the capacitive element resetting circuit and the resetting by the signal line potential resetting circuit.

According to the configuration set forth above, in each of the first through N−1th capacitive elements, one of the paired first reference voltages or one of the paired second reference voltages is selectively applied to one of the paired opposed electrodes according to the binary value of the most significant bit. First, the pair of the opposed electrodes are short-circuited and the electric charges are discharged in each of the first through N−1th capacitive elements by the capacitive element resetting circuit. On the other hand, the voltage of the signal line is selectively reset to the other of the paired first reference voltages or the other of the paired second reference voltages according to the binary value of the most significant bit by the signal line potential resetting circuit. After that, the first through N−1th capacitive elements are selectively connected to the signal lines by the first through N−1th switches of the selective switch circuit in accordance with the values of the lower N−1 bits. As a result, the voltages (positive or negative voltages) charged in the respective capacitive elements are applied as the driving voltages to the signal lines according to the steps of gray scale indicated by a digital image signal. Thus, it is possible to generate a driving voltage, which has been selected within the ranges of the reference voltages relatively reliably and accurately, by using a relatively simple composition.

Especially in this case, each of the capacitive elements constituting the switched capacitor type digital-to-analog converter are directly connected to the signal lines and the minimum electric charges required for charging the parasitic capacitance of the signal lines can be directly supplied from each of the capacitive elements. This is extremely advantageous in reducing the power consumed by the digital-to-analog converter and the driving circuit. In particular, the power consumption can be markedly reduced in comparison with the conventional case where a buffer circuit or the like is installed between the output terminal of the switched capacitor type digital-to-analog converter and the signal line to correct the nonlinearity of the driving voltage attributable to the parasitic capacitance of the signal line.

In this case, the capacitances of the first through N−1th capacitive elements may be set to $C\times2^{i-1}$ (C: Predetermined unit capacitance; i=1, 2, . . . , N−1).

This configuration makes it possible to change a driving voltage, which is obtained by selective voltage generation, at predetermined intervals so as to enable the optical characteristics in the electro-optical device to be changed at the predetermined intervals. Hence, stable multi-step gray scale can be indicated over the entire gray scale range.

In another embodiment of the driving circuit in accordance with the present invention set forth above, the values of the first and second reference voltages are set so that the difference between the driving voltage corresponding to the m−1th step of gray scale and the driving voltage corresponding to the m-th step of gray scale is smaller than a predetermined value.

According to this embodiment, the difference between the driving voltage corresponding to the m−1th step of gray scale, i.e. a driving voltage that lies within the first driving voltage range and that is closest to the second driving voltage range at the same time, and the driving voltage corresponding to the m-th step of gray scale, i.e. a driving voltage that lies within the second driving voltage range and that is closest to the first driving voltage range at the same time, is smaller than the predetermined value. Therefore, by setting the predetermined value to a value that has been experimentally established in advance, e.g. to a value corresponding to a difference in gray scale that cannot be recognized by human, it becomes possible to prevent a practically discontinuous change in the gray scale at the gap between the first and second driving voltage ranges (i.e. the boundary of the two ranges).

In this embodiment, the values of the first and second reference voltages may be set so that the ratio of the optical characteristics in the case where the electro-optical device is driven by the driving voltage corresponding to the m−1th step of gray scale and the case where the electro-optical device is driven by the driving voltage corresponding to the m-th step of gray scale is equal to one step of gray scale obtained by dividing the variation range of the optical characteristics by $(2^N-1)$.

According to such a composition, the driving voltage obtained by selective voltage generation can be changed at predetermined intervals even before and after the boundary of the first and second driving voltage ranges, so that the optical characteristics in the electro-optical device can be changed at predetermined intervals. This means that highly stable multi-step gray scale display can be achieved over the entire gray scale range including the gray scale range corresponding to the boundary.

In a further embodiment of the driving circuit in accordance with the present invention described above, the digital-to-analog converter is provided with a resistance ladder that divides the first and second reference voltages, respectively, by a plurality of resistors connected in series.

According to this embodiment, the plurality of resistors of the resistance ladder generate the voltages in the ranges of the first and second reference voltages by dividing the voltages. Thus, the driving voltages can be generated relatively reliably and accurately by dividing voltages by using a relatively simple composition.

This embodiment may be further provided with a selective voltage supply circuit for selectively supplying either the first or the second reference voltage to the digital-to-analog converter according to the value of the most significant bit of the digital image signal. The digital-to-analog converter may be further provided with a decoder that decodes the lower N−1 bits of the digital image signal and outputs decoded signals through $2^{N-1}$ output terminals, and $2^{N-1}$ switches, one terminal of each of which is connected to each of a plurality of taps drawn out among the plurality of resistors and the other terminal thereof is connected to each of the signal lines and the $2^{N-1}$ switches being respectively operated according to the decoded signals output through the $2^{N-1}$ output terminals.

In this case, the selective voltage supply circuit selectively supplies either the first or the second reference voltage to the digital-to-analog converter according to the binary value of the most significant bit of the digital image signal. Then, in the digital-to-analog converter, the decoder decodes the lower N−1 bits of the digital image signal and outputs binary decoded signals respectively through the $2^{N-1}$ output terminals. Then, when the $2^{N-1}$ switches respectively connected between the plurality of taps respectively drawn out among the plurality of resistors and the signal lines are operated according to the decoded signals output through the $2^{N-1}$ output terminals, the first and second reference voltages are divided according to the gray scale indicated by the digital image signal. As a result, the voltages obtained by the voltage division by the respective resistors are applied as the driving voltages to the signal lines according to the gray scale indicated by the digital image signal. Thus, it becomes possible to generate a driving voltage by relatively reliable and accurate voltage division by using a relatively simple configuration.

Dividing the voltage by using the resistance ladder is especially advantageous because it eliminates the possibility of the reverse change of the driving voltage with respect to the change in the gray scale via the gap (boundary) of the first and second driving voltage ranges.

In another embodiment of the driving circuit in accordance with the present invention set forth above, the signal lines are provided with predetermined capacitors in addition to the parasitic capacitance of the signal lines.

According to this embodiment, the changes in the driving voltage (output) with respect to the changes in the gray scale (input) in the digital-to-analog converter generating voltages in the ranges of the reference voltages as previously described exhibit, for example, asymptoteshaped nonlinearity due to the parasitic capacitance of the signal lines located on the output side; therefore, adding the predetermined capacitance as mentioned above makes it possible to bring the nonlinearity of the driving voltage to a desired one or somewhat close to a desired one. The specific value of the predetermined capacitance for obtaining such desired nonlinearity may be set by carrying out experiments, simulations, or the like. Thus, the nonlinearity of the driving voltages in the first and second driving voltage ranges can be matched to each other by the nonlinearity of the optical characteristics by adjusting the additional capacitance of the signal lines in addition to the selective voltage generation carried out based on the two different reference voltages (namely, the first and second reference voltages). As a result, the nonlinearity of the optical characteristics can be corrected by making use of the nonlinearity of the driving voltage that is more similar thereto.

In a further embodiment of the driving circuit in accordance with the present invention described above, the electro-optical device is a liquid crystal device composed of liquid crystal held between a pair of substrates, and the driving circuit is formed on one of the paired substrates.

According to this embodiment, a digital image signal can be directly input, and the gray scale display on the liquid crystal device can be accomplished at relatively low power consumption by using a relatively simple configuration. Furthermore, the γ correction of the liquid crystal device can be also made.

In this embodiment, each of the first and second reference voltages may be supplied to the digital-to-analog converter with the voltage polarity with respect to a predetermined reference potential being inverted for each horizontal scanning period.

According to the configuration described above, each of the voltage polarity of the first reference voltage and that of the second reference voltage is switched for each horizontal scanning period when supplying the reference voltages to allow the liquid crystal device to be driven by a scanning line reversing drive (so-called "1H reversing drive") system, wherein the driving voltage is inverted for each scanning line, or a pixel reversing drive (so-called "dot inverting drive") system. This prevents the flickers on a display screen and also prevents other problems such as a deterioration in liquid crystal due to the application of DC voltage. The predetermined potential providing the reference for the polarity inversion in this case is approximately equal to the opposed potential applied to one electrode of a liquid crystal pixel, to which the driving voltage supplied from the driving circuit is applied, and the other electrode opposed to the foregoing electrode via a liquid crystal layer. However, in the case of a configuration where the voltages are applied to liquid crystal pixels via switching elements such as transistors or nonlinear elements, the foregoing predetermined potential is biased with respect to the opposed potential, considering a drop in the applied voltage attributable to the parasitic capacitance of the switching elements, or the like.

To solve the technical problems described above, an electro-optical device in accordance with the present invention is provided with the driving circuit described above in accordance with the present invention, so that it permits direct input of a digital image signal, enabling an electro-optical device to be achieved that is capable of providing high-quality gray scale display at relatively low power consumption by using a relatively simple configuration.

To solve the technical problems described above, electronic equipment in accordance with the present invention is provided with the electro-optical device in accordance with the present invention described above, so that it makes it possible to accomplish various types of electronic equipment that has a relatively simple composition, consumes relatively low power, and is capable of providing high-quality gray scale display.

DETAILED DESCRIPTION OF PREFERRED EMBODIMENTS

The following will describe embodiments of the best modes for embodying the present invention in conjunction with the accompanying drawings.

(First Embodiment)

Figure 1:
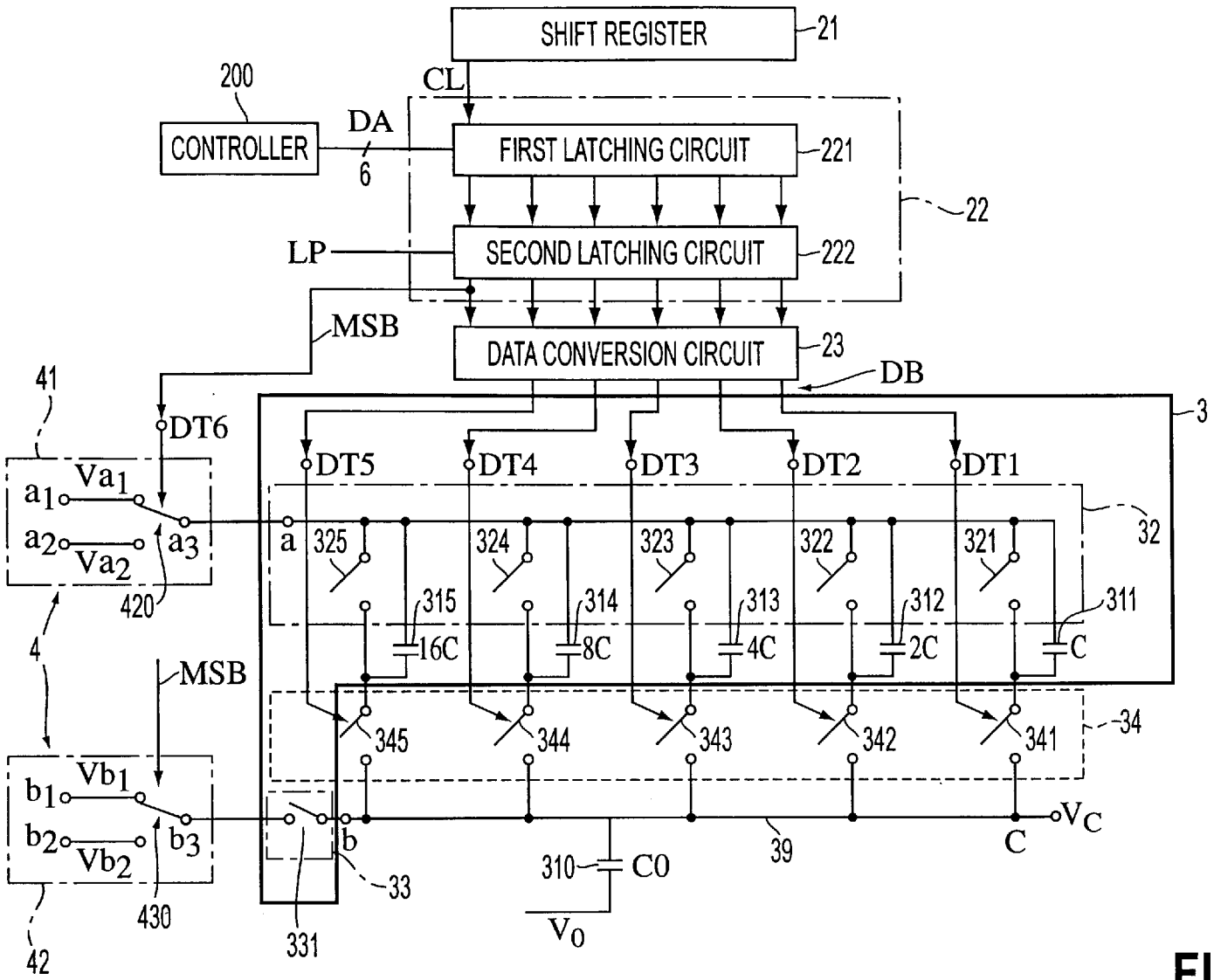
FIG. 1 is a circuit diagram showing an embodiment of a driving circuit employing an SC-DAC in accordance with the present invention.

FIG. 1 is a circuit diagram showing an embodiment of a driving circuit of a liquid crystal device in accordance with the present invention when the liquid crystal device, which is an example of an electro-optical device, is driven in a normally white mode. In FIG. 1, the driving circuit is adapted to perform 6-bit digital image processing, and it is constituted by a shift register 21, a latching device 22 composed of a first latching circuit 221 and a second latching circuit 222, a data conversion circuit 23 provided in the following stage, and a DAC 3 provided in the following stage, and a selective circuit 4.

A controller 200 provided outside the driving circuit sends out 6-bit image data $D_A$ (D1, D2, . . . , D6) in parallel to the driving circuit. The image data $D_A$ is digital image data indicative of an arbitrary step of gray scale among $2^6$ steps of gray scale. The latching device 22 constitutes an example of a digital interface; the first latching circuit 221 captures the bits D1, D2, . . . , D6 at a clock CL from the shift register 21 and sends them out to the second latching circuit 222 at a timing LP. The second latching circuit 222 sends out accumulated data to the data conversion circuit 23.

In FIG. 1, there is shown a unit circuit of the driving circuit for supplying a data signal voltage to one of the data signal lines of the liquid crystal device. Actually, as many shift registers 21 as the stages for supplying as many outputs as the data signal lines to the liquid crystal device are required. Likewise, as many latching devices 22 as the data signal lines are required. The same number of pieces of 6-bit image data as the number of horizontal pixels are sent out in parallel from the controller 200, and the shift register 21 gives outputs in sequence according to the sending-out timing. Upon receipt of each of the outputs of the shift register 21, the first latching circuit 221 of the driving circuit unit associated with each of the data signal lines latches the 6-bit image data in parallel at the same time. After the image data for the horizontal pixels has been latched at the first latching circuit 221, the image data for one line is transferred from the first latching circuit 221 to be simultaneously latched together at the second latching circuit by a latch pulse LP. From the moment the second latching circuit 222 latches the image data for one line, the DAC 3 begins DA conversion. Further, when image data for one line is latched at the second latching circuit 222, the image data of the horizontal pixels for the next line is sent out in sequence from the controller 200, and the first latching circuit 221 continues latching in sequence upon receipt of an output from the shift register 21 in the same manner as previously mentioned.

In response to the latch pulse LP, the image data for one horizontal pixel, one pixel being composed of 6-bit image data, is latched at the second latching circuit 222, and the image data for the one horizontal pixel is sent out at the same time to the data conversion circuit 23 of each driving circuit unit.

In this embodiment, if the value of a most significant bit D6 of the 6-bit image data DA is "0," then the data conversion circuit 23 sends out remaining lower bits D1 through D5 of the image data DA as they are to the DAC 3; if the value of the most significant bit D6 is "1," then it inverts the bits D1 through D5 before sending them out to the DAC 3. In this specification, the image data (the data composed of the lower bits D1 through D5 or inverted bits thereof) sent out by the data conversion circuit 23 to the DAC 3 will be denoted by $D_B$, and the inverted bits of the bits D1 through D5 will be accompanied by * and denoted as D1* through D5*.

The DAC 3 is a so-called "SC-DAC" and it is composed of a plurality of transistor switches and capacitors. Five, namely, first through fifth capacitive elements 311 through 315, are disposed in parallel. A capacitor C0 denoted as a signal line capacitor 310 is parasitically present in an output signal line 39 of the DAC 3. The output signal line 39 is connected to capacitive elements 311 through 315 via each of bit selective switches 341 through 345 making up a bit selective switching circuit 34. The DAC 3 further includes a capacitive element resetting device 32 and a signal line potential resetting device 33. The capacitive element resetting device 32 is composed of five switches 321 through 325. The respective switches 321 through 325 are provided among terminals of the respective capacitive elements 311 through 315; they allow the electric charges of the capacitive elements 311 through 315 to be discharged when they are turned ON at the same time. The signal line potential resetting device 33 is constituted by a switch 331 for selectively connecting or disconnecting a connecting terminal $b_3$ of a selective circuit 42, which will be discussed later, and the output signal line 39. When the switch 331 is ON, the potential of the output signal line 39 can be reset by reference voltage $V_{b1}$ or $V_{b2}$ which will be discussed later.

In FIG. 1, the signal line capacitor 310 provides the parasitic capacitance to the output signal line 39, the terminal potential (common potential) on the opposite side from the signal line being denoted by V0. The signal line 39 is wired toward a pixel area as the data signal line of the liquid crystal device. The signal line capacitor 310 provides the parasitic capacitance to the output signal line 39 and the data signal line of the pixel area joined thereto as previously mentioned. These signal lines have a capacitor formed between themselves and the electrode of a substrate opposed thereto via liquid crystal. In the pixel area of an active matrix liquid crystal panel, data signal lines and scanning signal lines cross each other or pixel electrodes are adjacently disposed, so that a parasitic capacitor is also formed between the data signal lines, the scanning signal lines, and the pixel electrodes. Alternatively, as it will be discussed later, the wiring width of the output signal line 39 may be increased around the pixel area to adjust the output characteristic curve of the DAC 3 and capacitance may be intentionally formed between the electrodes of the substrates opposed to each other with liquid crystal therebetween. The signal line capacitor C0 represents the total parasitic capacitance. In the drawing, the potential at the other end of the signal line capacitor 310 is shown as the electrode potential (common electrode potential) of the opposed substrate; it is indicated as the potential that contributes most as the potential at the other end of the capacitor when the value of the capacitance generated with the common electrode opposed to the output signal line 39 reaches a maximum value. The potential is not limited to the common electrode potential; as long as it is a potential that enables charging the signal line capacitor C0 in the relationship between the reference voltages $V_{b1}$ and $V_{b2}$, the capacitor may be formed between itself and other potential, and the potential may be defined as the potential at the other end.

The DAC 3 has first and second reference voltage input terminals "a" and "b." An output terminal (a connecting terminal a3) of the selective circuit 41 is connected to the first reference voltage input terminal "a," and an output terminal (a connecting terminal b3) of a selective circuit 42 is connected to the second reference voltage input terminal "b."

The selective circuits 41 and 42 have two terminals each as the input terminals, namely, a1, a2 and b1, b2, respectively. Voltages $V_{a1}$ and $V_{a2}$ are input to the input terminals al and a2 of the selective circuit 41. A switch 420 of the selective circuit 41 connects the connecting terminal a3 to al when the value of the most significant bit D6 (indicated by MSB in FIG. 1) of the input data $D_A$ is "0," while it connects the connecting terminal a3 to the input terminal a2 when the value of the most significant bit D6 is "1."

Further, voltages $V_{b1}$ and $V_{b2}$ are input to the input terminals b1 and b2 of the selective circuit 42. The switch 430 connects the connecting terminal b3 to the input terminal b1 when the value of the most significant bit D6 of the input data $D_A$ is "0," while it connects the connecting terminal b3 to b2 when the value of the most significant bit D6 is "1."

Thus, in this embodiment, the pair of the first reference voltages are comprised of the voltages $V_{a1}$ and $V_{b1}$, and the pair of the second reference voltages are comprised of voltages $V_{a2}$ and $V_{b2}$.

The bit selective switching circuit 34 is comprised of the switches 341 through 345 for selectively connecting or disconnecting the respective capacitive elements 311 through 315 and the output signal line 39; the switches are turned ON or OFF according to the values of the noninverted signals D1 through D5 or the inverted signals D1* through D5* from the data conversion circuit 23. The capacitances of the capacitive elements 311 through 315 are set by binary ratios and they are C, 2×C, 4×C, 8×C, and 16×C, respectively; total capacitance $C_T$ of the capacitive elements 311 through 315 connected in parallel is 31×C. According to a general formula, the capacitance of the capacitive elements 311 through 315 is $C \times 2^{j-1}$ (where: C denotes a predetermined unit capacitance; j=1, 2, . . . , N−1).

How each of the values of the two pairs of reference voltages $V_{a1}$ and $V_{b1}$ and $V_{a2}$ and $V_{b2}$ are determined in the driving circuit of this embodiment will now be described. In this embodiment, it is assumed that $V_{a1}>V_{b1}$ and $V_{a2}<V_{b2}$.

Figure 2:
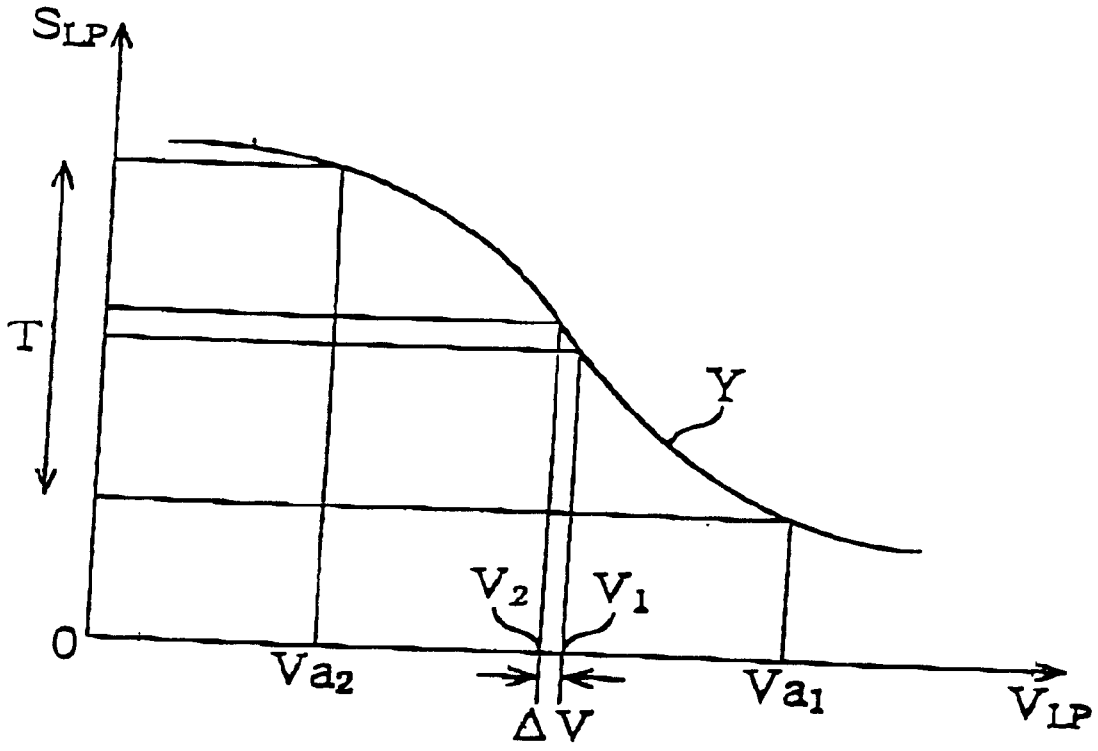
FIG. 2 is a diagram illustrative of a method whereby two voltages corresponding to the minimum value and the maximum value of transmittance are determined from a transmittance characteristic curve of liquid crystal pixels.

First, a transmittance variation range T is decided from a transmittance characteristic Y of a liquid crystal pixel that is indicated by an applied voltage $V_{LP}$ to the liquid crystal of a pixel taken on the abscissa and transmittance $S_{LP}$ of the pixel taken on the ordinate as shown in FIG. 2. Then, two voltages corresponding to the minimum value and the maximum value of the transmittance are determined from the transmittance characteristic curve of the liquid crystal pixel. In this case, the two voltages are denoted as $V_{a1}$ and $V_{a2}$ ($V_{a1}>V_{a2}$).

In this embodiment, the liquid crystal will be driven in the normally white mode; hence, when the transmittance reaches its maximum, the image data $D_A$ will be "000000." At this time, the lower five bits D1 through D5 ("00000") of the image data $D_A$ will be input directly to the data input terminals DT1 through DT5 of the DAC 3 shown in FIG. 1. Hence, all the bit selective switches 341 through 345 will be OFF. The most significant bit of the image data $D_A$ is "0," so that the switch 430 of the selective circuit 42 connects b3 to b1, and $V_{b1}$ appears at the reference voltage input terminal "b" of the DAC 3. This causes $V_{b1}$ to appear at the output signal line 39.

On the other hand, when the transmittance reaches its minimum, the image data $D_A$ is "111111." At this time, the inverted bits D1* through D5* "00000" are input to the data input terminals of the DAC 3. Hence, the bit selective switches 341 through 345 are all turned OFF in this case also. Further, the most significant bit of the image data $D_A$ is "1," so that the switch 430 of the selector circuit 42 connects b3 to b2 and $V_{b2}$ appears at the reference voltage input terminal "b" of the DAC 3. Thus, the output of the DAC 3 that corresponds to the maximum value of the transmittance of the transmittance variation range T is $V_{b1}$ and the output of the DAC 3 that corresponds to the minimum value of the transmittance is $V_{b2}$.

Further, if the image data $D_A$ is "011111," that is, if the value of the image data $D_A$ is set to a decimal value $2^{N-1}-1$, then the lower bits D1 through D5 "11111" are input as they are to the data input terminal of the DAC 3 shown in FIG. 1. In this case, the most significant bit of the image data $D_A$ is "0," so that the switch 420 of the selective circuit 41 connects the terminal a3 to the terminal a1, and $V_{a1}$ appears at the reference voltage input terminal "a" of the DAC 3. Also, the switch 430 of the selective circuit 42 connects the terminal b3 to the terminal b1, and $V_{b1}$ appears at the reference voltage input terminal "b" of the DAC 3. Then, on one hand, the switch 331 of the signal line potential resetting device 33 is turned ON once and then turned OFF to reset the signal line potential of the signal line 39 to $V_{b1}$. On the other hand, the five switches 321 through 325 of the capacitive element resetting device 32 are all turned ON once and then turned OFF to reset the voltages at both terminals of each capacitive element to $V_{a1}$. Under this condition, when the bit selective switch 34 is selectively turned ON (in this case, since the bits D1 through D5 are "11111," the bit selective switches 341 through 345 are all turned ON), the following voltage appears at the output signal line 39:

$$V_1=V_{a1}+\{(V_{b1}-V_{a1})\times 31C/(C0+31C)\} \quad (1)$$

Furthermore, if the image data $D_A$ is "100000," that is, if the value of the image data $D_A$ is set to a decimal value $2^{N-1}$, then the inverted bits D1* through D5* "11111" are input to the data input terminal of the DAC 3 shown in FIG. 1. First, the most significant bit of the image data $D_A$ is "1," so that the switch 420 of the selective circuit 41 connects the terminal a3 to the terminal a2, and $V_{a2}$ appears at the reference voltage input terminal "a" of the DAC 3. Also, the switch 430 of the selective circuit 42 connects the terminal b3 to the terminal b2, and $V_{b2}$ appears at the reference voltage input terminal "b" of the DAC 3. Then, on one hand, the switch 331 of the signal line potential resetting device 33 is turned ON once and then turned OFF to reset the signal line potential of the signal line 39 to $V_{b2}$. On the other hand, the five switches 321 through 325 of the capacitive element resetting device 32 are all turned ON once and then turned OFF to reset the voltages at both terminals of each capacitive element to $V_{a2}$. Under this condition, when the bit selective switch 34 is selectively turned ON (in this case, since the bits D1* through D5* are "11111," the bit selective switches 341 through 345 are all turned ON), the following voltage appears at the output signal line 39:

$$V_2=V_{a2}+\{(V_{b2}-V_{a2})\times 31C/(C0+31C)\} \quad (2)$$

Thus, as shown in FIG. 2, by appropriately selecting the value of $\Delta V=V_2-V_1$, the difference between the transmittance of the liquid crystal pixel obtained by the voltage (the output voltage of the DAC 3) appearing at the output signal line 39 when the image data $D_A$ is "011111" and the transmittance of the liquid crystal pixel obtained by the voltage appearing at the output signal line 39 when the image data $D_A$ is "100000" can be set to one step of gray scale of the transmittance variation range T (one step of gray scale on the logarithm axis).

The condition for the gray scale not to be reversed over the range of "011111" to "100000" is $\Delta V>0$, that is;

$$(31C/C_T)\times(V_{a1}-V_{a2})<V_{b2}-V_{b1}$$

In general, the following formula applies:

$$\Sigma Ci/C_T\times(V_{a1}-V_{a2})<V_{b2}-V_{b1}$$

(where the computation of $\Sigma$ is carried out on i=1 to i=N−1)

The above inequality formula holds if a voltage of the positive polarity is output from the driving circuit to the output signal line 39 when driving the liquid crystal of the pixels by AC. For this reason, it should be noted that all signs of inequality in the above inequality formula are reversed when a voltage of the negative polarity is output.

As it is obvious from the formulas (1) and (2) given above, if $V_{b1}-V_{b2}$ and $V_{a2}-V_{a1}$ remain constant, then the value of $\Delta V$ does not change. Hence, if, for example, $V_{b1}$ and $V_{b2}$ are set to fixed values, $V_{a2}-V_{a1}$ is set to a constant value, and the values of $V_{a2}$ and $V_{a1}$ are shifted in the positive or negative direction, then the center of the gray scale of the output characteristic curve of the DAC 3 with respect to the image data $D_A$ can be moved toward higher or lower transmittance.

Figure 3:
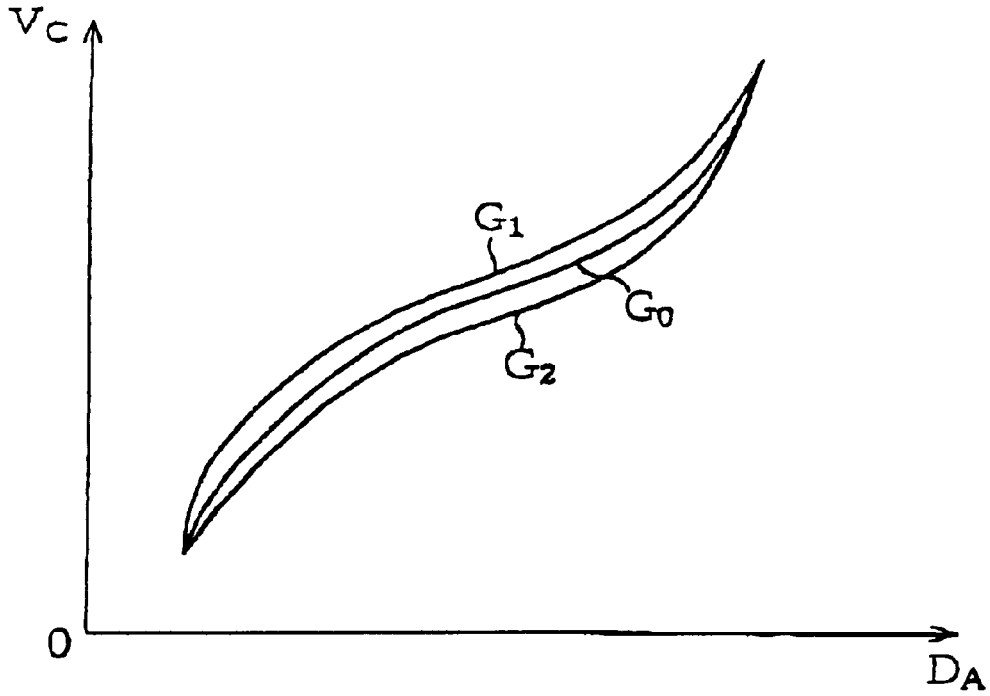
FIG. 3(A) is a diagram showing the changes in the output characteristic of the DAC observed when reference voltages are changed.
FIG. 3(B) is a diagram showing the changes in the output characteristic of the DAC observed when the total capacitance of capacitive elements is changed.
Figure 3:
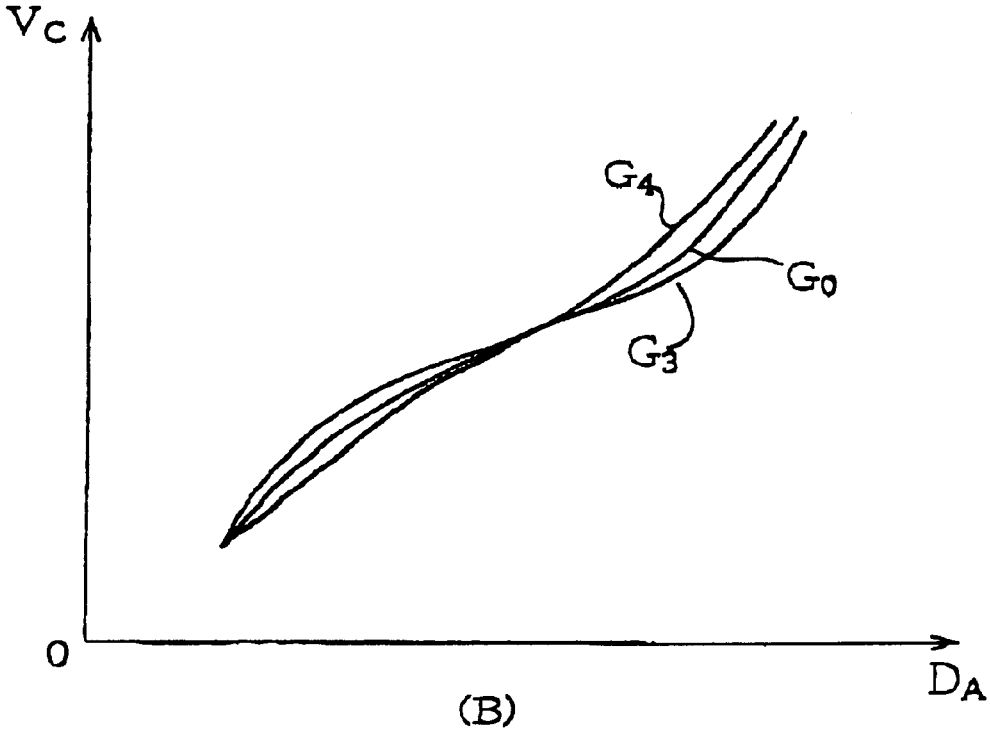

FIG. 3(A) shows the output characteristic (image data value $D_A$–Output voltage Vc of DAC) of the DAC 3 in a case (G1) where the voltage difference of $V_{a2}-V_{a1}$ is increased and a case (G2) where it is decreased while the voltage difference of $V_{b1}-V_{b2}$ is held constant, and the output characteristic before the change being denoted by G0.

As it is seen from formula (2) above, by appropriately setting the total capacitance $C_T$ of the capacitive elements 311 through 315 and the capacitance C0 of the signal line capacitor 310, the change in the gradient of the output characteristic curve of the DAC 3 with respect to the image data $D_A$ can be changed. More specifically, increasing $C_T$ with respect to C0 permits the change in the gradient of the output characteristic curve to increase, and decreasing $C_T$ with respect to C0 permits the output characteristic curve to be close to a straight line.

FIG. 3(B) shows the output characteristic (image data value $D_A$–Output voltage Vc of DAC) of the DAC 3 in a case (G3) where $C_T$ is increased with respect to C0 and a case (G4) where it is decreased while $V_{a1}$, $V_{a2}$, $V_{b1}$, and $V_{b2}$ are held constant, and the output characteristic before the change being denoted by G0.

To bring the output characteristic curve further close to a straight line, a capacitor of a predetermined capacitance may be connected in parallel to the signal line 39 to increase the capacitance C0 of the signal line capacitor 310. More specifically, by this configuration, the change in the driving voltage with respect to the change in the gray scale in the DAC 3 can be brought close to a straight line due to the increased capacitance of the signal line 39 as mentioned above; therefore, even when the γ characteristic is more linear, it can be handled by using the output characteristic curve of the DAC 3.

The operation of the DAC 3 when the two pairs of reference voltages $V_{a1}$, $V_{b1}$ and $V_{a2}$, $V_{b2}$ have been set and the total capacitance $C_T$ of the capacitive elements 311 through 315 has been set as set forth above will now be described in detail.

First, the most significant bit D6 of the image data $D_A$ input to the data conversion circuit 23 is input to a data input terminal DT6 of the DAC 3. If the value of the most significant bit D6 is "0," then the switch 420 of the selective circuit 41 connects the connecting terminal a3 to the terminal a1 and the switch 430 of the selective circuit 42 connects the connecting terminal b3 to the terminal b1. If the value of the most significant bit D6 is "1," then the switch 420 of the selective circuit 41 connects the connecting terminal a3 to the terminal a2 and the switch 430 of the selective circuit 42 connects the connecting terminal b3 to the terminal b2. At this time, the switches 321 through 325 of the capacitive element resetting device 32 and the switch 331 of the signal line potential resetting device 33 are both ON, while the switches 341 through 345 of the bit selective switching circuit 34 are OFF. This causes the capacitive elements 311 through 315 to discharge and both terminals of each thereof to be reset to the reset voltage $V_{a1}$ or $V_{a2}$ and the terminal of the signal line capacitor 310 (i.e. the output signal line 39) to be reset to $V_{b1}$ or $V_{b2}$.

Under this condition, the switches 321 through 325 and the switch 331 are turned OFF, then the switches 341 through 345 of the bit selective switching circuit 34 that had been OFF until then are selectively turned ON according to the values of the first bit D1 to the fifth bit D5 of the image data $D_A$. At this time, as previously mentioned, if the value of the most significant bit D6 of the image data $D_A$ input to the data conversion circuit 23 is "0," then the noninverted signals D1 through D5 of the lower five bits are input to the data input terminals DT1 through DT5 of the DAC 3, or if the value of the most significant bit D6 is "1," then the inverted signals D1* through D5* of the lower five bits are input thereto.

Therefore, if, for example, the image data $D_A$ is "000001," then 0, 0, 0, 0, 1 are respectively input to the five terminals DT1 through DT5 of the DAC 3, causing only the switch 341 among the switches of the bit selective switching circuit 34 to be turned ON. Likewise, if the image data $D_A$ is "111110," then 0, 0, 0, 0, 1 are respectively input to the five terminals DT1 through DT5 of the DAC 3, causing only the switch 341 among the switches of the bit selective switching circuit 34 to be turned ON also in this case.

Thus, a capacitive element of 311 to 315 connected to a switch that is ON among the switches 321 through 325 is connected to the signal line capacitor 310, and the voltage based on this connection appears at the output signal line 39.

For instance, if the image data $D_A$ is "000001," then the signal line capacitor 310 (capacitance C0) is charged by the voltages $V_{b1}$ and V0 at both terminals. The capacitive element 311 (capacitance C) connected to the signal line 39 via the switch 341 after all the switches 321 through 325 of the capacitive element resetting device 32 are turned OFF is charged by the reference voltages $V_{a1}$ and $V_{b1}$ (on the other hand, the capacitive elements 312 through 315 are not charged by the reference voltages $V_{a1}$ and $V_{b1}$ because the switches 342 through 345 remain OFF). Hence, the capacitive element 311 (capacitance C) and the signal line capacitor 310 (capacitance C0) cause a voltage, which looks as if it were obtained by substantially dividing the pair of reference voltages $V_{a1}$ and $V_{b1}$ (i.e. $V_{b1}-V_{a1}$), to appear at the output signal line 39.

Further, if the image data $D_A$ is "111110," then the signal line capacitor 310 (capacitance C0) is charged by the voltages $V_{b2}$ and V0 at both terminals. The capacitive element 311 (capacitance C) connected to the signal line 39 via the switch 341 after all the switches 321 through 325 of the capacitive element resetting device 32 are turned OFF is charged by the reference voltages $V_{a2}$ and $V_{b2}$ (on the other hand, the capacitive elements 312 through 315 are not charged by the reference voltages $V_{a2}$ and $V_{b2}$ because the switches 342 through 345 remain OFF). Hence, the capacitive element 311 (capacitance C) and the signal line capacitor 310 (capacitance C0) cause a voltage, which looks as if it were obtained by substantially dividing the pair of reference voltages $V_{a2}$ and $V_{b2}$ (i.e. voltages $V_{b2}-V_{a2}$), to appear at the output signal line 39.

Figure 4:
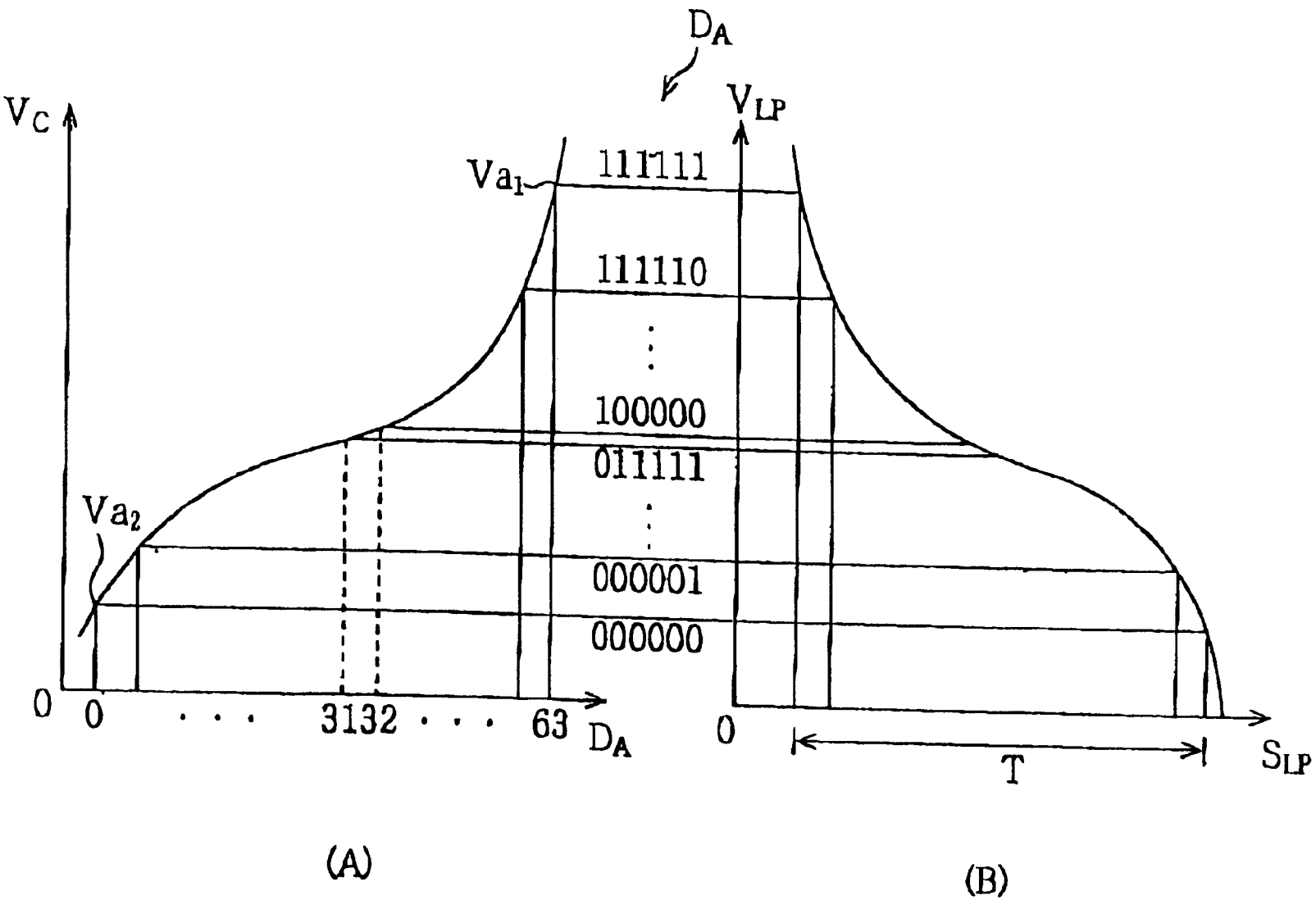
FIG. 4 is a diagram showing the changes in the input/output characteristic of the DAC in the driving circuit of FIG. 1; graph (A) on the left indicates the output voltage of the DAC with respect to image data, while graph (B) on the right indicates the voltage applied to liquid crystal pixel electrodes with respect to the transmittance of liquid crystal pixels.
Figure 21:
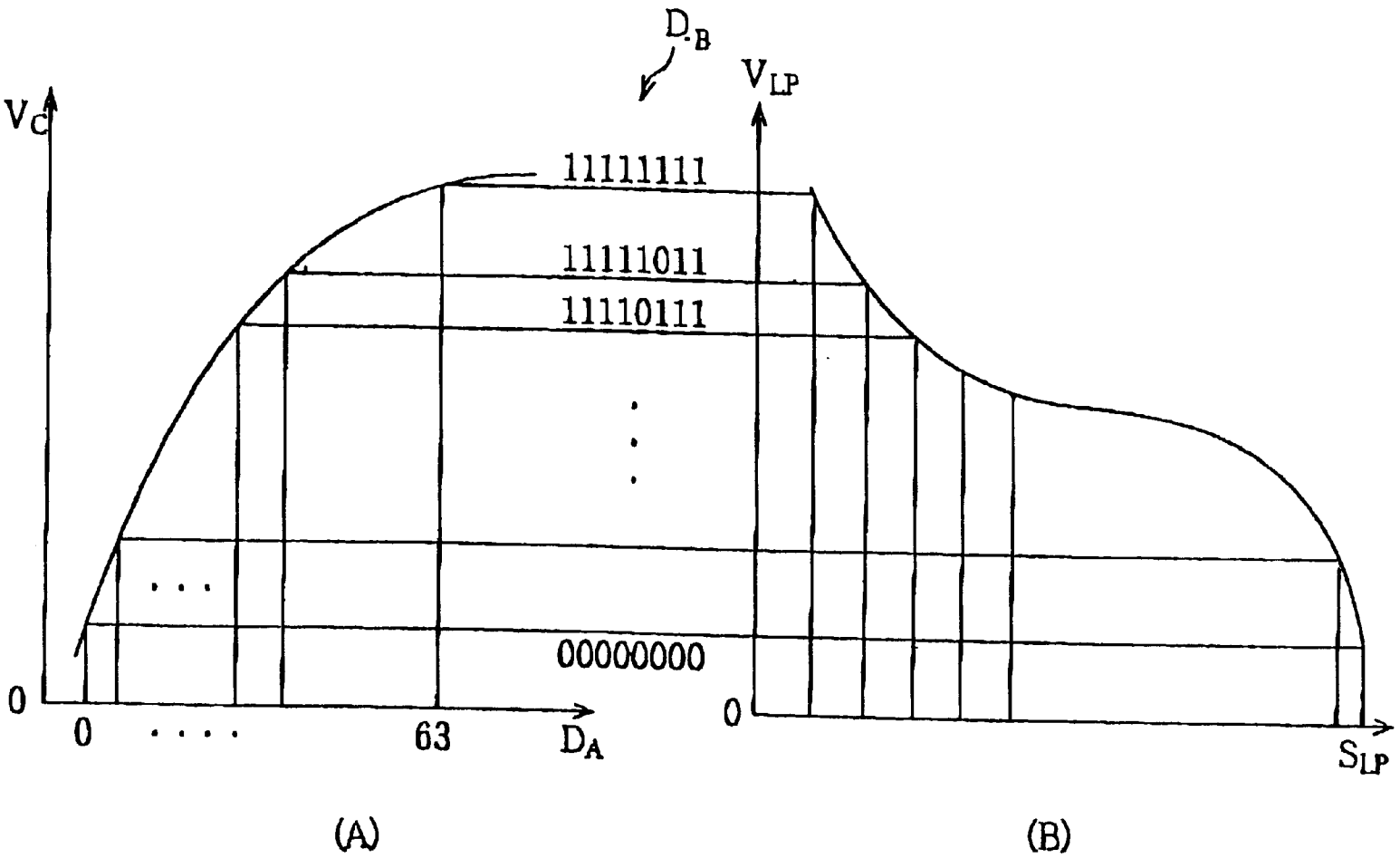
FIG. 21 is a diagram illustrative of the input/output characteristics of a DAC used for a conventional driving circuit; graph (A) on the left shows the output voltage of the DAC with respect to image data, while graph (B) on the right shows the voltage applied to a liquid crystal pixel electrode with respect to the transmittance of a liquid crystal pixel.

In FIG. 4, graph (A) on the left shows the output voltage Vc of the DAC 3 with respect to the image data $D_A$ (expressed in 64 steps of gray scale), and graph (B) on the right shows the relationship between a transmittance $S_{LP}$ (axis: logarithm) of a liquid crystal pixel and a voltage $V_{LP}$ (corresponding to the output voltage Vc of the DAC 3) applied to a liquid crystal pixel electrode, the transmittance $S_{LP}$ being indicated on the abscissa and the applied voltage $V_{LP}$ being indicated on the ordinate. "111111" to "000000" of the image data $D_A$ are binary codes of the image data indicative of 64 steps of gray scale. As it becomes apparent by referring to graphs (A) and (B) in FIG. 4 in contrast to graphs (A) and (B) in FIG. 21, the DAC 3 in accordance with the present invention makes a γ correction while carrying out D/A conversion at the same time.

Shifting all the reference voltages $V_{a1}$, $V_{a2}$, $V_{b1}$, and $V_{b2}$ to the high voltage side or the low voltage side makes it possible to shift the overall luminance (transmittance) in the pixels to the low side or the high side. Furthermore, by setting the voltage difference $V_{b1}-V_{b2}$ to a large value beforehand, the contrast ratio can be increased, or by setting it to a small value, the contrast ratio can be decreased.

Figure 5:
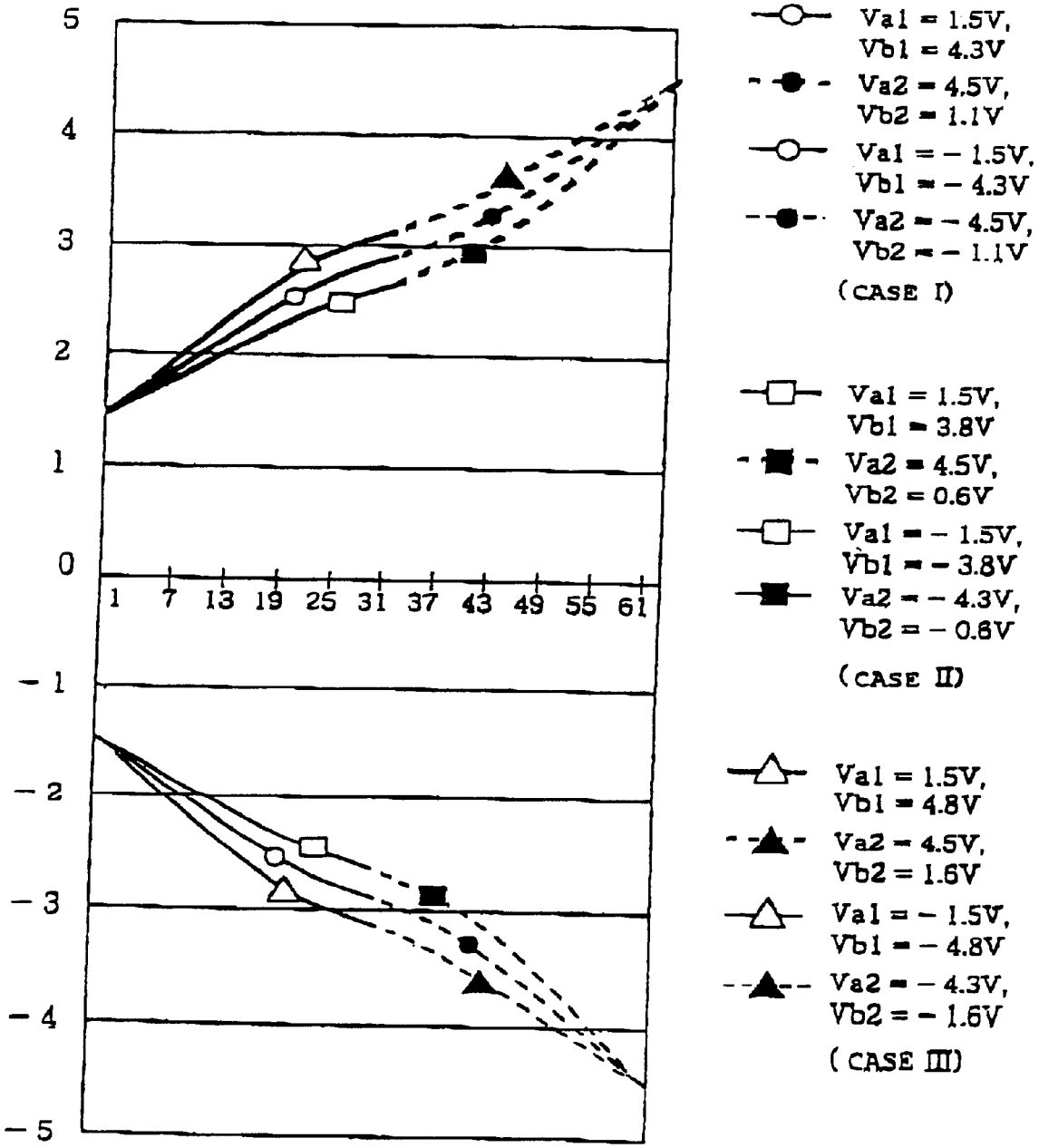
FIG. 5 is a graph showing the relationship between the transmittance of the liquid crystal pixels and the voltage applied to the liquid crystal pixel electrodes in three cases (I through III).

FIG. 5 gives a graph indicative of the relationship between the transmittance of liquid crystal pixels and the voltage applied to the liquid crystal pixel electrodes in three cases (indicated by cases I through III) where actual measurement has been performed in this embodiment. In FIG. 5, the voltages of the positive and negative polarities of $V_{a1}$, $V_{a2}$, $V_{b1}$, and $V_{b2}$ are respectively applied in the respective cases I through III. This is because there are cases where a voltage of the positive polarity is output and cases where a voltage of the negative polarity is output with respect to the reference voltage (0V in the case of FIG. 5) to the data signal line to drive the liquid crystal of the pixels in the AC mode. If $V_{a1}$, $V_{a2}$, $V_{b1}$, and $V_{b2}$ are positive voltages, then the voltage of the positive polarity is applied to the pixel liquid crystal, or if they are negative voltages, then the voltage of the negative polarity is applied thereto.

Accordingly, in the driving circuit of FIG. 1, in actual use, as $V_{a1}$, $V_{a2}$, $V_{b1}$, and $V_{b2}$, respectively, the reference voltage for applying the voltage of the positive polarity and the reference voltage for applying the voltage of the negative polarity are switched at a regular cycle and applied.

Regarding the switching cycle of the voltages $V_{a1}$, $V_{a2}$, $V_{b1}$, and $V_{b2}$, if the driving method of the liquid crystal device is such that the polarity of the voltage applied to the liquid crystal is inverted at every vertical scanning period (1 field or 1 frame), then the switching of the voltages is performed at every vertical scanning period; if the polarity is inverted at every horizontal scanning period (so-called "line inverting drive"), then the switching of the voltages is performed at every horizontal scanning period. Further, if the polarity is inverted at every column line (so-called "source line inversion") or if the polarity is inverted at every pixel (so-called "dot inverting drive"), then the polarities of the voltages applied as $V_{a1}$, $V_{a2}$, $V_{b1}$, and $V_{b2}$ with respect to the reference voltages are different alternately for every adjacent unit driving circuit. More specifically, the reference voltage applied as $V_{a1}$ is for the positive polarity in the unit driving circuit of a first data signal line, while the reference voltage applied as $V_{a1}$ is for the negative polarity in the unit driving circuit of a second data signal line; thus the voltages are different. The reference voltage for each unit driving circuit is switched for every vertical scanning period in the case of the source line inversion, or for every horizontal scanning period in the case of the dot inversion.

In the first embodiment set forth above and other embodiments to be described below, the description is given, the relationship between the image data D1 through D6 and the terminals DT1 through DT6 may be reversed so that "111111" denotes white and "000000" denotes black. Further, in this embodiment, the same apparently applies to even the orientation of liquid crystal molecules and the setting of the axis of polarization are changed (to the normally black mode) so that the transmittance is high when the output voltage of the DAC is low, while the transmittance is low when the output voltage thereof is high.

Figure 6:
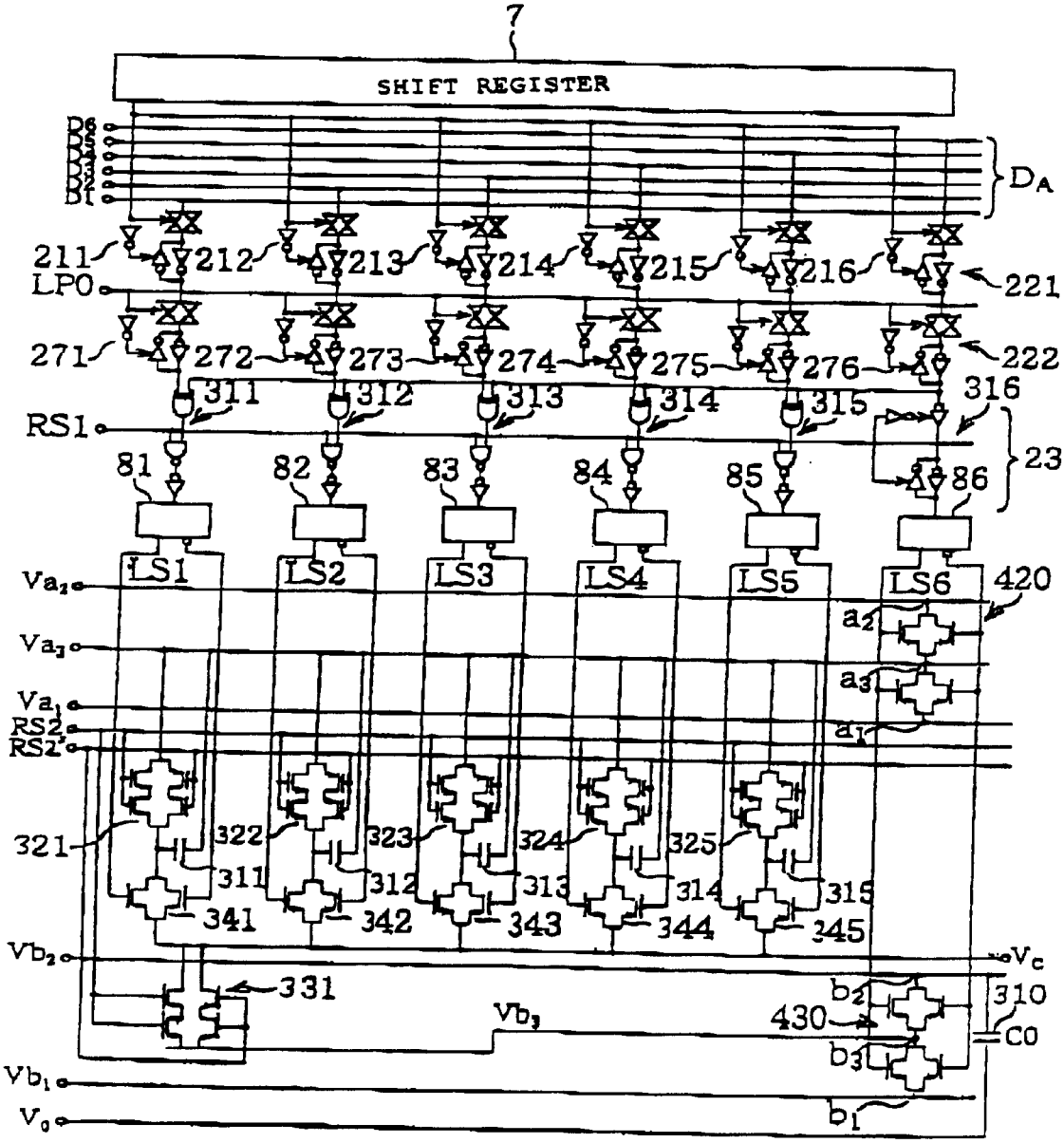
FIG. 6 is a circuit diagram showing a detailed configuration of a first embodiment.
Figure 7:
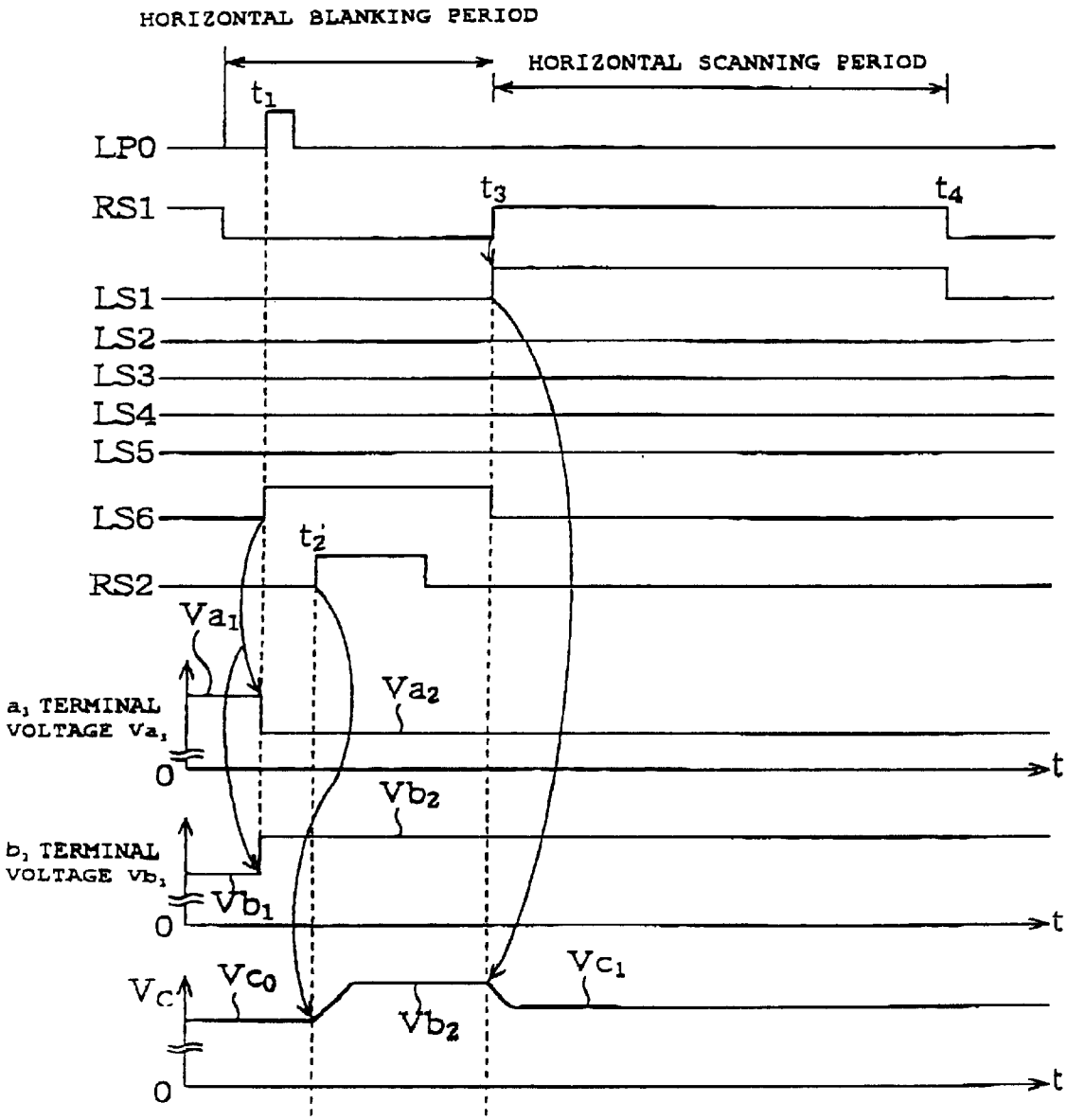
FIG. 7 is a timing chart illustrating the operation of the embodiment of FIG. 6.

More detailed configuration and operation of the driving circuit of the first embodiment will now be described with reference to FIG. 6 and FIG. 7. FIG. 6 is a detailed circuit diagram of the driving circuit of the embodiment, and FIG. 7 is a timing chart thereof. In FIG. 7, like constituent parts as those shown in FIG. 1 are assigned like reference numerals and the description thereof will be omitted as necessary.

In FIG. 6, six latching elements 211 through 216 of a first latching circuit 221 are respectively driven by the output pulses of a shift register 7; they are adapted to latch 6-bit image data for one pixel on a data line at the same time. Only one unit of driving circuit is shown for the first latching circuit 221; however, a similar first latching circuit is configured also for the unit driving circuit adjoining the latching circuit. In the first latching circuit 221, however, the latching is controlled by a different output of the shift register 7 for each unit driving circuit.

A second latching circuit 222 is configured so that it captures all bits D1, D2, . . . , D6 retained at the first latching circuit 221 into each of latching elements 271 through 276 by a latch pulse LP0 and outputs them to the data conversion circuit 23. Like the first latching circuit 221, the second latching circuit 222 is provided at each unit driving circuit; however, the second latching circuit 222 of each unit driving circuit is different from the first latching circuit 221 in that it latches at the same time by the same latch pulse LP0.

The data conversion circuit 23 is made up of five sets of gate circuits 311 through 315, each of which is composed of an EX-OR gate, a NAND gate, and a NOT gate, and a latching gate 316.

Each of the EX-OR gate of the gate circuits 311 through 315 inputs the respective bit values D1 through D5 of the image data $D_A$ from the latching elements 271 through 276, and the latching gate 316 inputs the value of the most significant bit D6. Each EX-OR gate is configured so that, if the value of the most significant bit D6 is "1," then it inverts the values of the lower bits D1 through D5 before it outputs them to the NAND gate in the following stage, or if the value of the most significant bit D6 is "0," then it outputs the values of the lower bits D1 through D5 to the NAND gate in the following stage without inverting them.

Level shifting circuits 81 through 86 are the circuits for shifting, for example, a binary voltage level from 0 V and 5 V to 0 V and 12 V; each of them has two output terminals for a noninverted output and an inverted output. The outputs of these two output terminals are sent out to the DAC 3 in the following stage. In FIG. 6, the noninverted output signals of the level shifting circuits 81 through 86 are denoted by LS1 through LS6.

In this embodiment, the respective capacitive elements 311 through 315 are constituted by patterns. Regarding each of the capacitive elements 312 through 315, the capacitive element 312 is constituted by connecting in parallel two capacitors of the same capacitance as that of the capacitance C of the capacitive element 311, the capacitive element 313 is constituted by connecting in parallel four capacitors of the same capacitance as that of the capacitance C of the capacitive element 311, the capacitive element 314 is constituted by connecting in parallel eight capacitors of the same capacitance as that of the capacitance C of the capacitive element 311, and the capacitive element 315 is constituted by connecting in parallel sixteen capacitors of the same capacitance as that of the capacitance C of the capacitive element 311. The reference voltages of the voltages $V_{a1}$, $V_{a2}$, $V_{b1}$, and $V_{b2}$ are of AC (the voltage polarity is inverted, for example, for every scanning line, field, or frame); hence, each of the switches 341 through 345 is composed of a CMOS transistor having two control terminals to enable operation regardless of whether the polarity of a signal to be controlled is positive or negative. More specifically, the noninverted output signals LS1 through LS5 from the level shifting circuits 81 through 86 are adapted to actuate each of the switches 341 through 345 when the capacitive element resetting voltages $V_{a1}$, $V_{a2}$ and the signal line potential resetting voltages $V_{b1}$, $V_{b2}$ are positive, while the inverted output signals from the level shifting circuits 81 through 86 are adapted to actuate each of the switches 341 through 345 when the capacitive element resetting voltages $V_{a1}$, $V_{a2}$ and the signal line potential resetting voltages $V_{b1}$, $V_{b2}$ are negative.

The operating of the driving circuit configured as illustrated in FIG. 6 will now be described with reference to the timing chart given in FIG. 7.

In FIG. 7, first, during a previous horizontal scanning period, the first latching circuit 221 sequentially latches the image data for the number of the horizontal pixels for each unit driving circuit according to a transfer signal issued in sequence from the shift register 7. Then, when the image data for one horizontal pixel has been latched and when the latch pulse LP0 is generated at time t1 in a horizontal blanking period, the second latching circuit 222 captures each of the bits D1, D2, . . . , D6 held at the first latching circuit 221 into each of the latching elements 271 through 276 and outputs them to the data conversion circuit 23.

Next, when a reset signal RS1 is input to the respective NAND gates of the data conversion circuit 23, the outputs of the EX-OR gates are output to the level shifting circuits 81 through 85 via the NOT gates during a period from $t_3$ to $t_4$ (i.e. the horizontal scanning period) during which the reset signal RS1 stays at the H level. When the latch pulse LP0 is input, the most significant bit D6 is output to the level shifting circuit 86 from the latching gate 316.

In this embodiment, the value of the most significant bit D6 is "1" and therefore, a noninverted output LS6 of the most significant bit D6 from the level shifting circuit 86 is switched to the high level at time t1 which is the timing at which the latch pulse LP0 is generated. And the actuation of the switch 420 causes the resetting voltage $V_{a2}$ to appear at a selected terminal $a_3$ at time t1. Also, the actuation of the switch 430 causes a signal line potential resetting voltage $V_{b2}$ to appear at a selected terminal $b_3$ at time t1.

Then, when a reset signal RS2 or its inverted signal (this inverted signal is denoted by RS2* in FIG. 6) is generated at time t2, the switches 321 through 325 of the capacitive element resetting device and the switch 331 of the signal line potential resetting device are turned ON. At this time, the period during which the reset signal RS2 is at the high level is later than the timing at which the latch pulse LP0 is generated but earlier than time t3 at which the reset signal RS1 rises.

Subsequently, when a reset signal RS3 is generated at time t3 under a condition where the switch 331 of the signal line resetting device is OFF, the potential of the signal line is $V_{b2}$, the switches 321 through 325 of the capacitive element resetting device are OFF, and the capacitive elements 311 through 315 are chargeable, the switches 341 through 345 of the bit selective switching circuit are selectively turned ON in accordance with the values of the outputs of the level shifting circuits 81 through 85. In this embodiment, only LS1 among the outputs LS1 through LS5 of the level shifting circuits 81 through 85 is switched to the H level; therefore, the voltage (the output voltage Vc of the DAC 3), which is generated by the connection between the capacitive element 311 and the signal line capacitor 310, will appear at the output signal line 39, and the output voltage Vc is applied to the signal line in the horizontal scanning period.

As described in detailed above, according to the first embodiment, the output voltage in accordance with the step of gray scale indicated by the bits of the digital image data $D_A$ can be supplied to the respective signal lines of the liquid crystal device and the γ correction can be made at the same time.

(Second Embodiment)

A second embodiment of the driving circuit of a liquid crystal device in accordance with the present invention will now be described with reference to FIG. 8.

Figure 8:
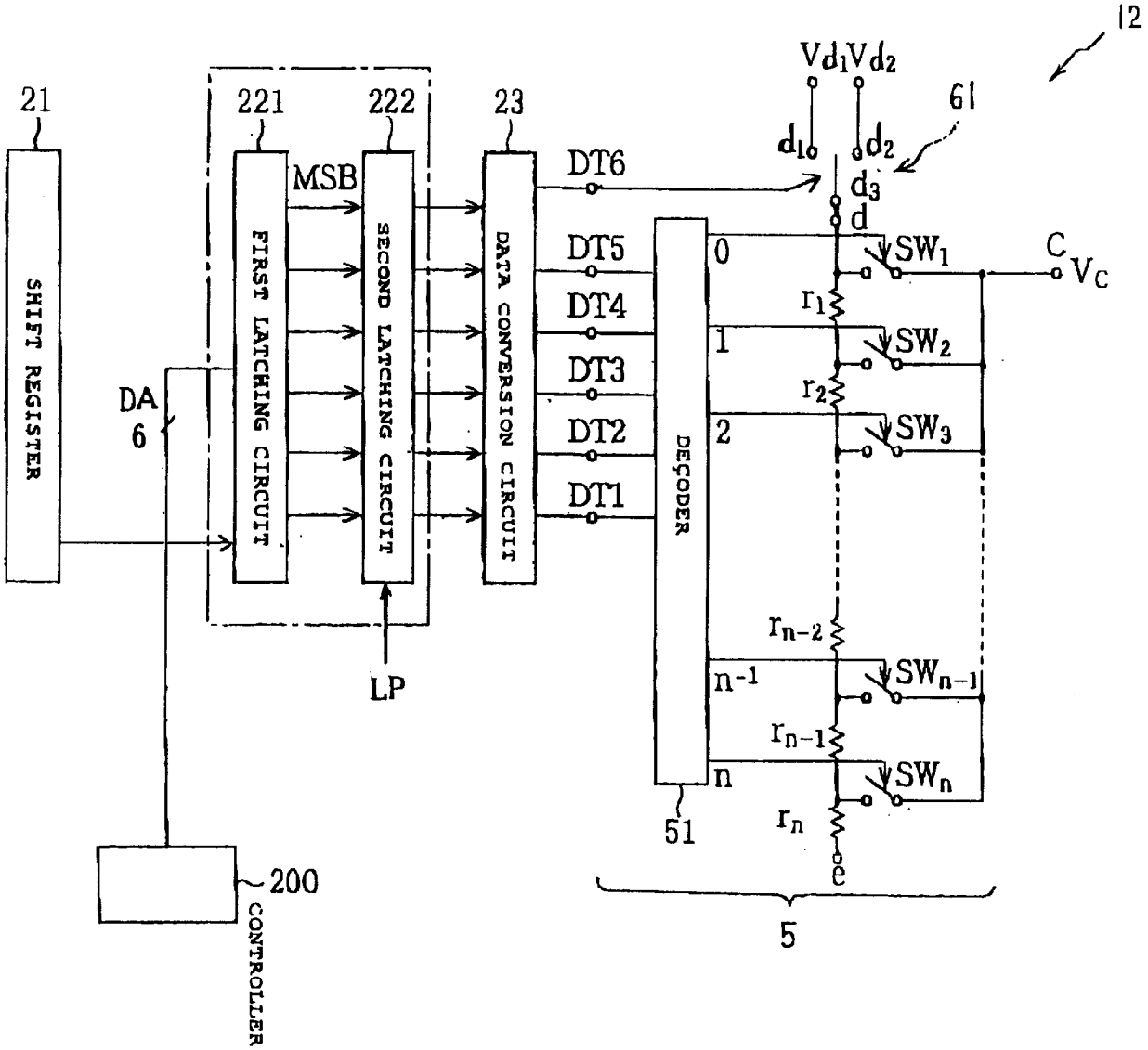
FIG. 8 is a circuit diagram showing a second embodiment of a driving circuit employing a resistance ladder type DAC in accordance with the present invention.

FIG. 8 shows the second embodiment that employs a resistance ladder type DAC in place of the SC-DAC shown in FIG. 1. In FIG. 8, a driving circuit 12 is comprised of a shift register 21, a latching device 22 composed of a first latching circuit 221 and a second latching circuit 222, a data conversion circuit 23, and a DAC 5. The configurations and functions of the shift register 21, the latching device 22, and the data conversion circuit 23 are the same as those of the first embodiment. In FIG. 8, the same constituent elements as those shown in FIG. 1 are given the same reference numerals and the description thereof will be omitted as necessary. In the second embodiment also, the detailed configuration (the shift register, the latching means, and the data conversion circuit) up to the stage preceding the DAC is identical to that of the first embodiment shown in FIG. 6.

As in the case of the driving circuit shown in FIG. 1, when a controller 200 sends out 6-bit image data $D_A$ to the driving circuit 12, the latching device 22 sends out the six bits D1 through D6 of the image data $D_A$ to the data conversion circuit 23. The data conversion circuit 23 sends out the most significant bit D6 and the lower bits D1 through D5 without inverting them to the input terminal of the DAC 5 if the value of the most significant bit D6 is "0." If the value of the most significant bit D6 is "1," then the data conversion circuit 23 inverts the values of the lower bits D1 through D5 and sends the inverted bits as well as the most significant bit D6 to the input terminal of the DAC 5.

The DAC 5 is comprised of a decoder 51, 25 resistors $r_1$ through $r_n$ ($n=2^5$) connected in series, and an "n" number of switches $SW_1$, through $SW_n$ ($n=2^5$). In this case, the value of each "r" of the resistors $r_1$ through $r_n$ is set so that the voltage Vc output according to the value of the combined resistance of the resistors connected in series that are selected among the resistors $r_1$ through $r_n$ by the image data $D_A$ changes as shown in FIG. 4(A) except for the last resistor $r_n$ that is set to $r_n \approx r_{n-1}/2$. Setting to $r_n \approx r_{n-1}/2$ makes it possible to set the difference between the transmittance of the liquid crystal pixel obtained by the output voltage Vc of the DAC 5 when $D_A$ is "011111" and the transmittance obtained by the output voltage Vc of the DAC 5 when $D_A$ is "100000" to approximately one step of gray scale (one step of gray scale in logarithm) of a transmittance variation range T of the liquid crystal pixel.

First and second reference input terminals "d" and "e" are connected to both ends of the series connection circuit of the resistors $r_1$ through $r_n$. One end of the switch $SW_1$ is connected to a reference voltage input terminal "d" of the DAC 5 (the end on the side of $r_1$ of the series connection circuit of the resistors $r_1$ through $r_n$), and one end of each of the switches $SW_2$ through $SW_n$ is connected to the connection (tap) of $r_1$ through $r_n$ of the series connection circuit, while the other end of each of the switches $SW_1$ through $SW_n$ is connected to the output terminal Vc of the DAC 5.

A selective circuit 61 is connected to the reference voltage input terminal "d" of the DAC 5. The selective circuit 61 has two input terminals $d_1$ and $d_2$ and one connection terminal $d_3$, voltages $Vd_1$ and $Vd_2$ being input to these terminals. A reference voltage input terminal "e" is fixed at a midpoint potential Ve. In this embodiment, $Vd_1$ and Ve make up a pair of first reference voltages, and $Vd_2$ and Ve make up a pair of second reference voltages. There is an established relationship $Vd_1>Ve>Vd_2$ between the voltages $Vd_1$, $Vd_2$, and Ve.

The selective circuit 61 connects a connection terminal $d_3$ to an input terminal $d_2$ when the value of the most significant bit D6 of input data $D_A$ is "0" or it connects the connection terminal $d_3$ to an input terminal $d_1$ when the value of the most significant bit D6 is "1."

In the driving circuit 12 of FIG. 8, if, for example, the image data $D_A$ is "000001," then the most significant bit D6 is "0"; therefore, the data conversion circuit 23 outputs the lower bits D1 through D5 to the decoder 51 without inverting them. The selective circuit 61 connects the connection terminal $d_3$ to the input terminal $d_2$. Further, 0, 0, 0, 0, 1 are input to five terminals DT1 through DT5 of the decoder 51 (the decode value at this time is "1"), and only the switch $SW_2$ corresponding to a decode value "1" among the switches $SW_1$ through $SW_n$ will be turned ON. Accordingly, the voltage Vc as shown below will appear at the output terminal C of the DAC 5:

$$Vc=Vd_2+(Ve-Vd_2)\times[r_1/(r_1+r_2+\ldots+r_n)]$$

If, for example, image data $D_A$ is "111110," then the most significant bit D6 is "1"; therefore, the data conversion circuit 23 inverts the lower bits D1 through D5 before it outputs them to the decoder 51. The selective circuit 61 connects the connection terminal $d_3$ to the input terminal $d_1$. Further, 0, 0, 0, 0, 1 are input to each of the five terminals DT1 through DT5 of the decoder 51 (the decode value at this time is "1"), and only the switch $SW_1$ corresponding to the decode value "1" among the switches $SW_1$ through $SW_n$ will be turned ON. Accordingly, the voltage Vc as shown below will appear at the output terminal C of the DAC 5:

$$Vc=Vd_1-(Vd_1-Ve)\times[r_1/(r_1+r_2+\ldots+r_n)]$$

As in the case of the first embodiment, as the voltages $Vd_1$, $Vd_2$, and Ve, the reference voltage used when a voltage of the positive polarity is applied to the pixels and the reference voltage used when a voltage of the negative polarity is applied to the pixels are periodically switched to carry out the scanning line reversing drive or the like and are supplied to each of them. The switching timing is the same as that explained in the case of the first embodiment.

The configuration of the DAC used for the present invention is not limited to the one in the first or second embodiment shown in FIG. 1 or FIG. 8 as long as the changes occur from a large gradient to a small gradient in the small area/large area of input data value, whereas the changes occur from small gradient to a large gradient in the large area/small area of the input data value. Various types of the DAC may be employed.

In the embodiments set forth above, the description has been given to the cases where the 6-bit digital image data is processed. The present invention, however, is not limited thereto; it is obvious that the invention may be applied to perform the processing of a variety of digital image data of 4 bits, 5 bits, 7 bits, or more.

Likewise, in the above embodiments, the values of the first through fifth bits have been inverted when the value of the most significant bit of the image data $D_A$ was "1"; alternatively, however, the configuration may be such that the values of the first through fifth bits are inverted (they are output as they are when the value of the most significant bit is "1")when the value of the most significant bit of the image data $D_A$ is "0".

Further in this embodiment, the normally white mode has been used; however, the same can be embodied even if the normally black mode is used.

(Third Embodiment)

An embodiment of a liquid crystal device which is an example of the electro-optical device in accordance with the present invention will be described with reference to FIG. 9 through FIG. 17.

Figure 9:
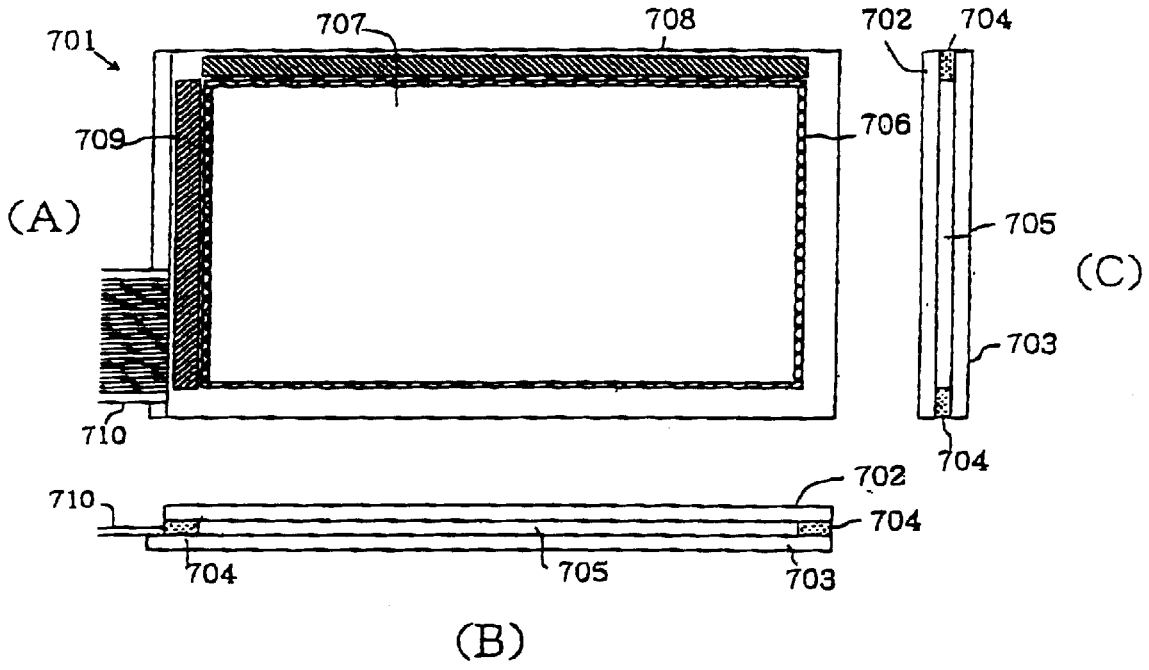
FIG. 9(A) is a top plan view of an embodiment of a liquid crystal device in accordance with the present invention.
FIG. 9(B) is a cross-sectional view of the liquid crystal device of FIG. 9(A).
FIG. 9(C) is a longitudinal sectional view of the liquid crystal device of FIG. 9(A).

The driving circuits in each of the embodiments set forth above are employed to drive a liquid crystal device 701 shown, for example, in a top plan view (A), a cross-sectional view (B), and a longitudinal sectional view (C) of FIG. 9.

In FIG. 9, liquid crystal 705 is charged between an active matrix substrate 702 and an opposed substrate (a color filter substrate) 703; it is sealed by a sealant 704 on the peripheries of each of the substrates. A light-shielding pattern 706 is formed along the periphery of the active matrix substrate 702 excluding the peripheral edge portion. Formed inside the light-shielding pattern 706 is an active matrix section 707 composed of pixel electrodes, output signal lines (data lines), scanning lines or the like. Provided in the foregoing peripheral edge portion are a driver 708 in which as many driving circuits in each of the above embodiments as pixel array columns are formed, and a scanning line driver 709. Further, a mount terminal member 710 is provided on the outer side of the scanning driver 709 in the peripheral edge portion.

Figure 10:
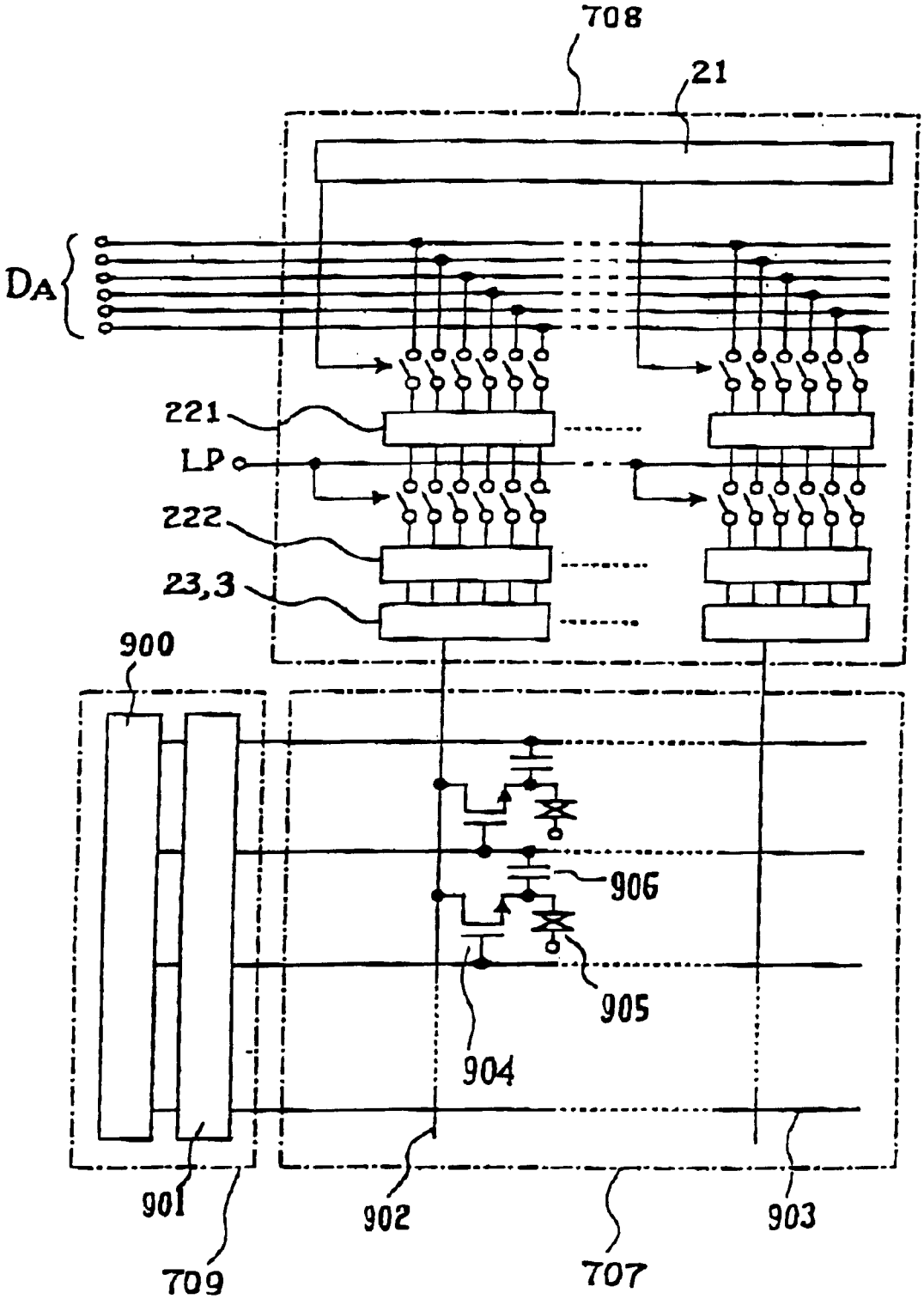
FIG. 10 is a circuit diagram of the liquid crystal device of FIG. 9.

The circuit diagram of the above active matrix type liquid crystal device is shown in FIG. 10.

In FIG. 10, pixels are formed in a matrix pattern in the active matrix section 707. In the active matrix section 707, a data signal line 902 is driven by the signal line driver 708 in which the unit driving circuits described in the first or second embodiment are disposed to match data signal lines, and the scanning line 903 is driven by the scanning line driver 709. Each pixel is comprised of: a thin film transistor (TFT) 904 having its gate connected to the scanning line 903, its source connected to the data signal line 902, and its drain connected to a pixel electrode (not shown); liquid crystal 905 disposed between the pixel electrode and a common electrode (not shown); and a charge accumulating capacitor 906 formed between the pixel electrode and its adjacent scanning line. The scanning line driver 709 is constituted by a shift register 900 that sequentially provides outputs during every horizontal scanning period to decide the timing for selecting a scanning line, and a level shifter 901 that receives the outputs of the shift register 900 and outputs a scanning signal of the voltage level that turns the TFT 904 ON to the scanning line 903.

The signal line driver 708 is provided with a shift register 21, a first latching circuit 221, a second latching circuit, a data conversion circuit 23, a DAC 3 or the like as previously mentioned.

A process (process employing a low temperature polysilicon technique) for forming the driving circuits (the driver 708), the active matrix section 707 or the like on the aforesaid active matrix substrate 702 will now be described step by step with reference to FIGS. 11 through 15.

Figure 11:
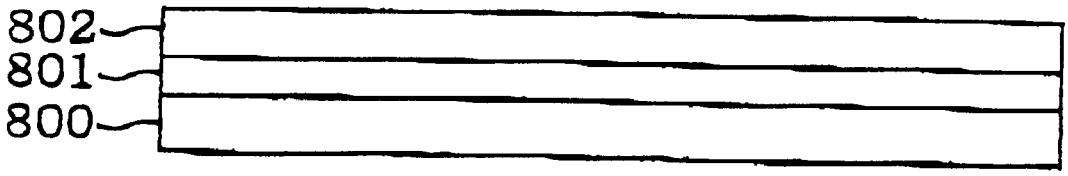
FIG. 11 is a schematic representation illustrative of a first step of the manufacturing process of the liquid crystal device shown in FIG. 9.

Step 1: First, as shown in FIG. 11, a buffer layer 801 is formed on an active matrix substrate 800, and an amorphous silicon layer 802 is formed over the buffer layer 801.

Figure 12:
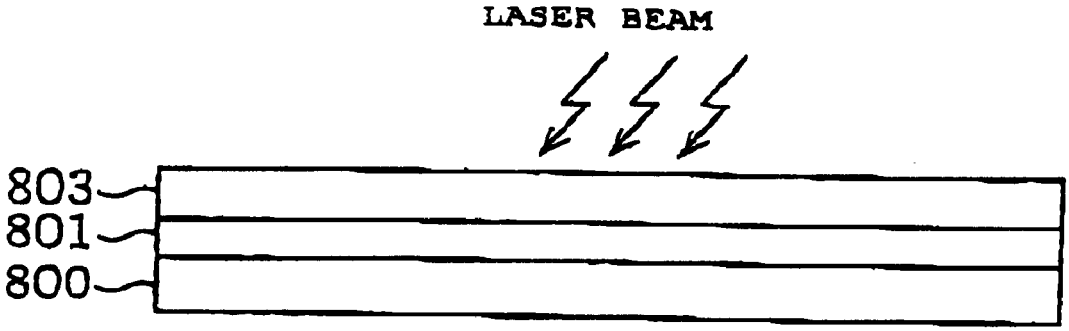
FIG. 12 is a schematic representation illustrative of a second step of the manufacturing process of the liquid crystal device shown in FIG. 9.

Step 2: Then, the whole surface of the amorphous silicon layer 802 of FIG. 11 is subjected to laser annealing to make the amorphous silicon layer polycrystalline so as to form a polycrystalline silicon layer 803 as shown in FIG. 12.

Figure 13:
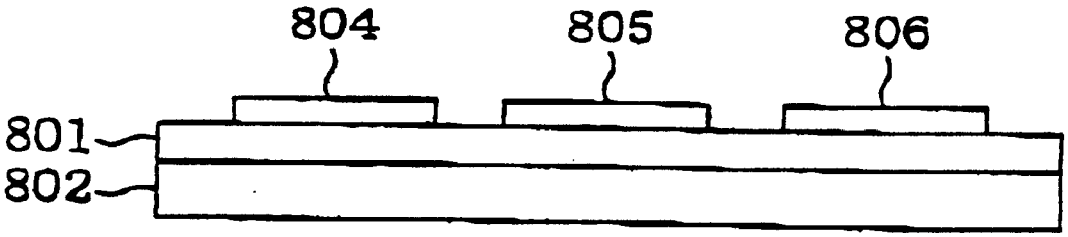
FIG. 13 is a schematic representation illustrative of a third step of the manufacturing process of the liquid crystal device shown in FIG. 9.

Step 3: Next, the polycrystalline silicon layer 803 is patterned to form island regions 804, 805, and 806 as shown in FIG. 13. The island regions 804 and 805 are the layers where the active regions (sources and drains) of MOS transistors employed as each of the switches shown in the embodiments are formed. The island region 806 is the layer that provides one pole of the thin film capacitor of the capacitive element shown in the embodiments.

Figure 14:
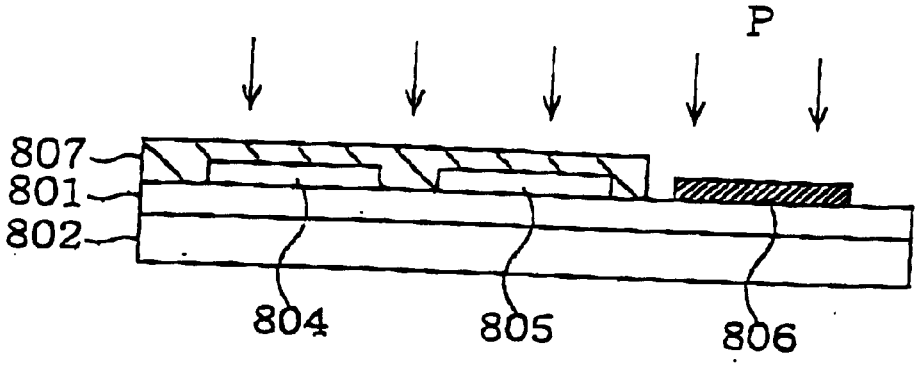
FIG. 14 is a schematic representation illustrative of a fourth step of the manufacturing process of the liquid crystal device shown in FIG. 9.

Step 4: Next, as shown in FIG. 14, a mask layer 807 is formed, and phosphorous (P) ions are implanted only in the island region 806 that provides one pole of the thin film capacitor of the capacitive element so that the island region 806 has lower resistance.

Figure 15:
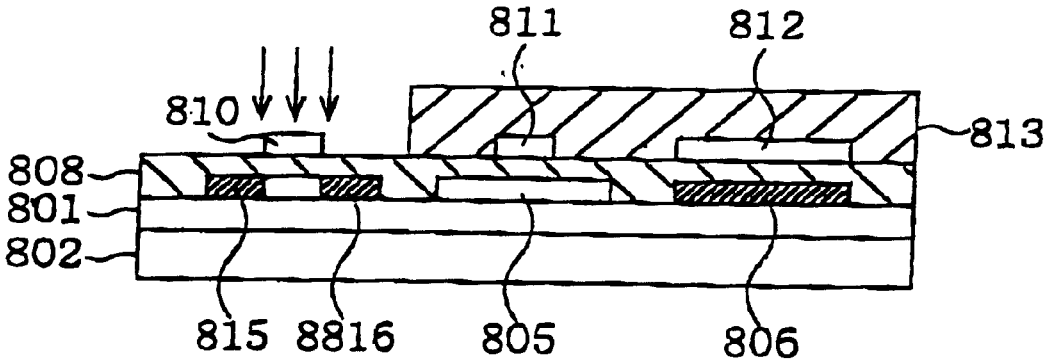
FIG. 15 is a schematic representation illustrative of a fifth step of the manufacturing process of the liquid crystal device shown in FIG. 9.

Step 5: Next, as shown in FIG. 15, a gate insulating film 808 is formed, and TaN layers 810, 811, and 812 are formed on the gate insulating film 808. The TaN layers 810 and 811 are the layers that provide the gates of the MOS transistors employed as various switches, while the TaN layer 812 is the layer that provides the other pole of the thin film capacitor. After producing these TaN layers, a mask layer 813 is formed, and phosphorous (P) ions are implanted in self-alignment by using the gate TaN layer 810 as the mask to form an n-type source layer 815 and drain layer 816.

Figure 16:
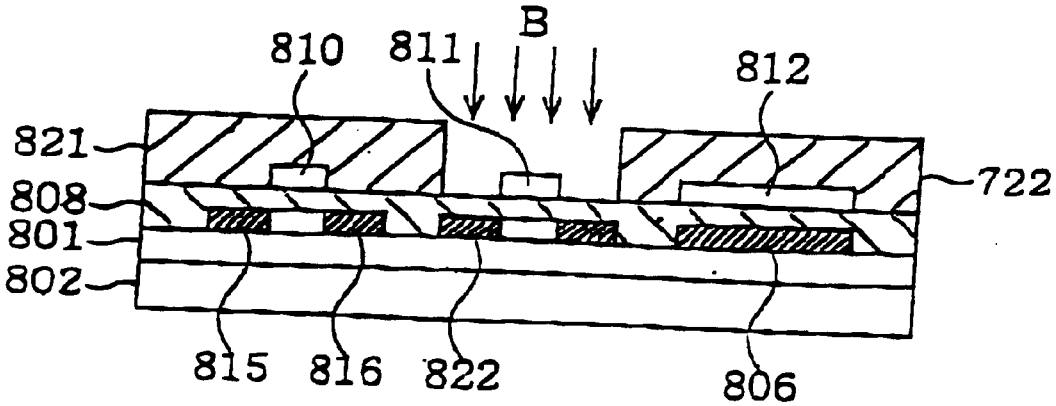
FIG. 16 is a schematic representation illustrative of a sixth step of the manufacturing process of the liquid crystal device shown in FIG. 9.

Step 6: Next, as shown in FIG. 16, mask layers 821 and 822 are formed, boron (B) ions are implanted in self-alignment by using the gate TaN layer 811 as the mask to form a p-type source layer 821 and drain layer 822.

Figure 17:
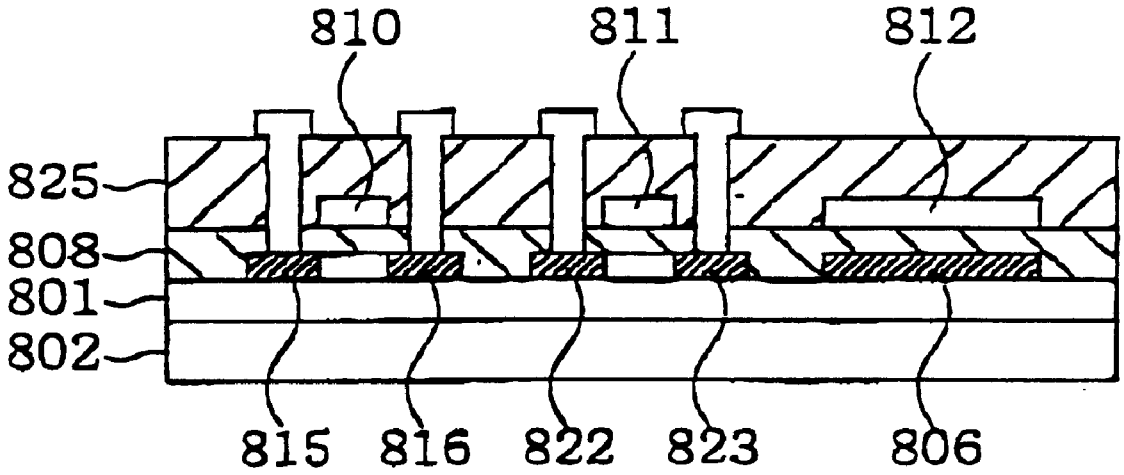
FIG. 17 is a schematic representation illustrative of a seventh step of the manufacturing process of the liquid crystal device shown in FIG. 9.

Step 7: Next, as shown in FIG. 17, an interlayer insulating film 825 is formed and contact holes are formed in the interlayer insulating film, then electrode layers 826, 827, 828, and 829 composed of ITO or Al are formed. Electrodes are connected also to the TaN layers 810, 811 and 812, and the polycrystalline silicon layer 806 via the contact holes although they are not shown in FIG. 17. Thus, an n-channel TFT and a p-channel TFT employed as each of the switches of the driving circuit, and a MOS capacitor used as the capacitive element also of the driving circuit are produced.

Using the steps 1 through 7 set forth above permits easier manufacture of the liquid crystal device including the driver circuitry and also enables reduced cost to be achieved. The polysilicon provides significantly higher mobility of carriers than amorphous silicon, so that it permits high-speed operation, which is advantageous in achieving higher performance of the circuit.

A process employing amorphous silicon may be used in place of the manufacturing process set forth above.

The driving circuits of the liquid crystal devices of the embodiments described above may be constituted by thin film transistors, resistive elements and capacitive elements formed by silicon thin film layers or metal layers on a glass substrate made of quartz glass, non-alkali glass or the like, or they may be formed on other substrates (e.g. synthetic resin substrates and semiconductor substrates) other than the glass substrates. In the case of a semiconductor substrate, metallic reflector electrodes are used for pixel electrodes, the transistor elements, resistive elements, and capacitive elements are formed on the surface of the semiconductor substrate or the surface of the substrate, and a glass substrate is used for the opposed substrate, thereby to accomplish a reflective type liquid crystal device having liquid crystal held between the semiconductor substrate and the glass substrate. When forming the driving circuits on the glass substrate having a lower melting point, it is preferable to use the manufacturing process employing the low temperature polysilicon technique (TFT process) to improve reliability.

The liquid crystal devices in the embodiments described above are of the active matrix type; however, there are no restrictions on the type of the liquid crystal device, and other types than the active matrix type can be used. Further, various types of DAC may be used; when forming the circuits on the glass substrate, however, it is preferable to employ the SC type DAC or the resistance ladder type DAC to achieve reduced variations in the operating characteristics and improved reliability. In the embodiments set forth above, the present invention has been applied to the liquid crystal device as an example of the electro-optical device; however, the same or similar advantages can be expected by applying the present invention as long as the electro-optical device exhibits nonlinear optical characteristic with respect to driving voltage.

In particular, when forming the driving circuits in each of the embodiments on silicon substrates, it is preferable to use the resistance ladder type DAC which makes it easy to produce high resistance in a relatively small area and to minimize variations. Likewise, when using the silicon semiconductor substrate, it is preferable to configure a reflective type liquid crystal panel. Conversely, when forming the driving circuits on the glass substrate, the use of the SC-DAC makes it possible to configure the device by using elements of relatively small areas, so that the area of the whole circuitry can be made smaller, providing advantages.

In particular, even when the driving circuits are formed on the glass substrate by the manufacturing process employing the low temperature polysilicon technique, the SC-DAC or the resistance ladder type DAC can be used as the DAC, enabling smaller driving circuits to be accomplished without complicating the circuit configuration.

Diverse embodiments of the liquid crystal device driven by the aforesaid driving circuits manufactured using the active matrix substrate described above and electronic equipment such as a portable computer and a liquid crystal projector having the liquid crystal device will now be described.

(Fifth Embodiment)

Figure 18:
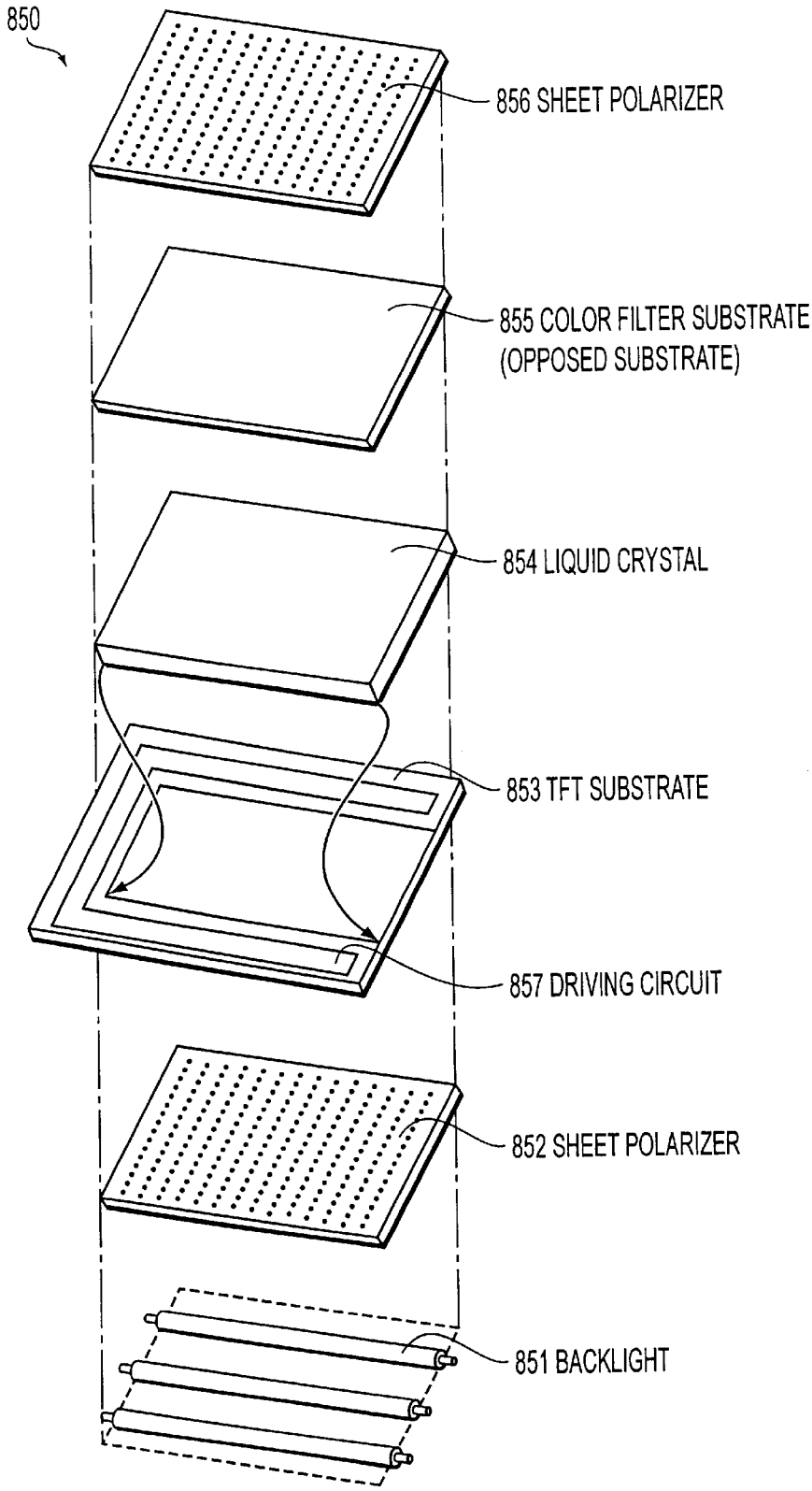
FIG. 18 is a schematic exploded view of another embodiment of the liquid crystal device in accordance with the present invention.

As illustrated in FIG. 18, a liquid crystal device 850 is constructed by a backlight 851, a polarizer 852, a TFT substrate 853, liquid crystal 854, an opposed substrate (a color filter substrate) 855, and a polarizer 856 that are assembled in the order in which they are listed. In this embodiment, a driving circuit 857 is formed on the TFT substrate 853 as described above.

(Sixth Embodiment)

Figure 19:
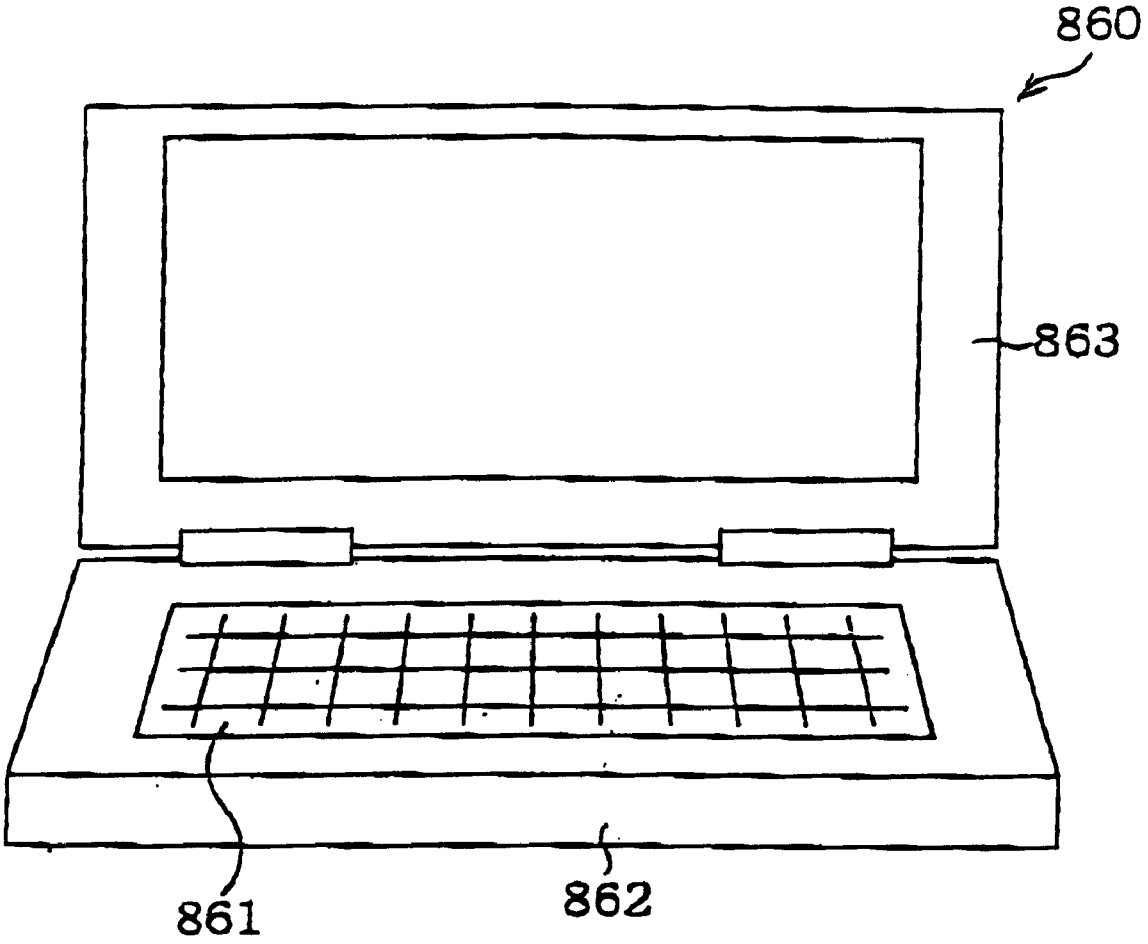
FIG. 19 is a schematic representation showing an embodiment (portable computer) of electronic equipment in accordance with the present invention.

As shown in FIG. 19, a portable computer 860 has a main unit 862 provided with a keyboard 861, and a liquid crystal display screen 863.

(Seventh Embodiment)

Figure 20:
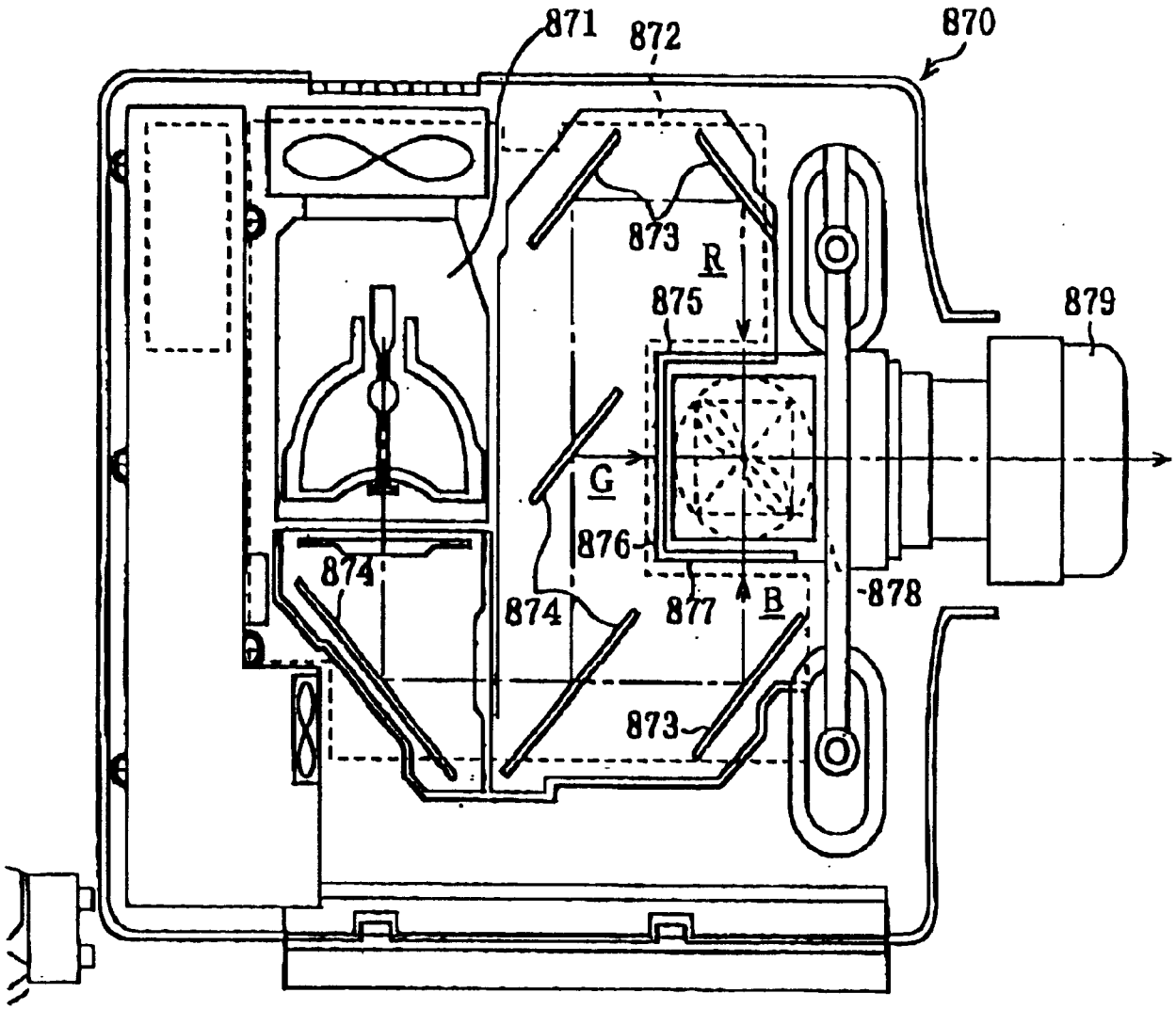
FIG. 20 is a schematic representation showing another embodiment (projector) of the electronic equipment in accordance with the present invention.

As shown in FIG. 20, a liquid crystal projector 870 is a projector employing a transmissive type liquid crystal panel as a light valve; it uses, for example, a 3-panel prism type optical system. In the projector 870 shown in FIG. 20, the projection light emitted from a lamp unit 871, which is a white light source, is separated into three primary colors, namely, R, G, and B, through a plurality of mirrors 873 and two dichroic mirrors 874 in a light guide 872 and the three color light beams are guided to three liquid crystal panels 875, 876, and 877 that display the images of the respective colors. The light beams that have been modulated by the respective liquid crystal panels 875, 876, and 877 are incident upon a dichroic prism 878 from three directions. The light beams of R (red) and B (blue) are bent by 90 degrees through the dichroic prism 878, whereas the light beam of G (green) goes straight therethrough, so that the images of the respective colors are synthesized thereby to project a color image on a screen or the like through a projection lens 879.

Electronic equipment to which the present invention can be applied includes an engineering workstation, a pager or a portable telephone, a word processor, a TV set, a viewfinder type or monitor viewing type video camera, an electronic pocketbook, an electronic desktop calculator, a car navigation device, a POS terminal, and a variety of devices provided with touch panels.

As described above, according to each of the embodiments, it is possible to achieve a reliable driving circuit of a liquid crystal device that is compatible to digital image signals, provides stable operating characteristics with controlled variations, and provides the DA converting function and the $\gamma$ correcting function (or an auxiliary function for the $\gamma$ correction) by a relatively simple and a small-scale circuit configuration, and a liquid crystal device and a variety of electronic equipment employing the driving circuit.

INDUSTRIAL APPLICABILITY

The driving circuit of an electro-optical device in accordance with the present invention can be used as the driving circuit for driving a transmissive or reflective type liquid crystal device, and further, it can be used as the driving circuit for driving diverse electro-optical devices that exhibit nonlinear changes in optical characteristics with respect to the changes in driving voltage while correcting the nonlinearity at the same time. Moreover, the driving circuit of the electro-optical device in accordance with the present invention can be used for a variety of electro-optical devices constructed using such a driving circuit and also for electronic equipment or the like constituted using such electro-optical devices.

What is claimed is:

1. A driving circuit of an electro-optical device that supplies an analog image signal, which has a driving voltage corresponding to an arbitrary gray scale level among $2^N$ (where N is a natural number) steps of gray scale, to a signal line of an electro-optical device in which changes in an optical characteristic thereof with respect to changes in said driving voltage are nonlinear; said driving circuit of an electro-optical device comprising:

an input interface to which an N-bit digital image signal indicative of said arbitrary gray scale level is applied; and a digital-to-analog converter that generates a driving voltage within a first driving voltage range defined by a first pair of reference voltages or within a second driving voltage range defined by a second pair of reference voltages according to a bit value of said digital image signal and corresponding to the gray scale level of said digital image signal so that changes in said driving voltage with respect to changes in the gray scale level of said digital image signal are nonlinear; the digital-to-analog converter generates a voltage within the range of the first pair of reference voltages if said applied digital image signal indicates a gray scale level from a first to m−1th value (where "m" is a natural number and $1 < m \leqq 2^N$), and generates a voltage within the range of the second pair of reference voltages adjacent to said first driving voltage range if said digital image signal indicates a gray scale level from an m-th to $2^N$-th value, and supplies said analog image signal including said generated driving voltage to said signal line.

2. The driving circuit of an electro-optical device according to claim 1, wherein a first reference voltage of said first pair of reference voltages is greater than the second reference voltage of said first pair of reference voltages; and a first reference voltage of said second pair of reference voltages is less than the second reference voltage of said second pair of reference voltages, a change in said driving voltage corresponding to a change in the gray scale having an inflection point within ranges defined by said first pair of reference voltages and said second pair of voltages respectively.

3. The driving circuit of an electro-optical device according to claim 1, wherein:

the value of said "m" is equal to $2^{N-1}$;

lower N−1 bits of said digital image signal are selectively applied to said digital-to-analog converter either inverted or non-inverted according to a value of a most significant bit of said digital image signal; and said digital-to-analog converter generates a voltage in the range of said first reference voltages if said lower N−1 bits are applied non-inverted, and generates a voltage in the range of said second reference voltages if said lower N−1 bits are inverted before being applied thereto.

4. The driving circuit of an electro-optical device according to claim 3, further comprising a selective inverting circuit for selectively inverting said lower N−1 bits depending upon the value of said most significant bit, said selective inverting circuit being provided between said interface and said digital-to-analog converter.

5. The driving circuit of an electro-optical device according to claim 1, further comprising a selective voltage supply circuit for selectively supplying either said first or second reference voltages to said digital-to-analog converter according to a value of a most significant bit of said digital image signal.

6. The driving circuit of an electro-optical device according to claim 1, wherein said digital-to-analog converter comprises a switched capacitor type digital-to-analog converter that generates driving voltages in the ranges of said first and second reference voltages, respectively, by means of charging a plurality of capacitors.

7. The driving circuit of an electro-optical device according to claim 6, wherein said first reference voltages include a pair of voltages that enable a voltage in said first driving voltage range to be selectively generated, and said second reference voltages include a pair of voltages that enable a voltage in said second driving voltage range to be selectively generated.

8. The driving circuit of an electro-optical device according to claim 7, wherein:

the value of said "m" is equal to $2^{N-1}$;

the lower N−1 bits of said digital image signal are selectively applied to said switched capacitor type digital-to-analog converter either inverted or non-inverted before being applied thereto according to a value of a most significant bit of said digital image signal; and said switched capacitor type digital-to-analog converter generates a voltage in the range of said first reference voltages if said lower N−1 bits are applied non-inverted, and generates a voltage in the range of said second reference voltages if said lower N−1 bits are inverted before being applied thereto.

9. The driving circuit of an electro-optical device according to claim 6, wherein said switched capacitor type digital-to-analog converter comprises:

a first through an N−1th capacitive elements, each capacitive element respectively having a pair of opposed electrodes, wherein one of said first reference voltages or one of said second reference voltages is selectively applied to one of said opposed electrodes according to a value of a most significant bit of the digital image signal;

a capacitive element resetting circuit for short-circuiting said pair of opposed electrodes in each of said first through N−1th capacitive elements so as to discharge electric charges therein;

a signal line potential resetting circuit for selectively resetting a potential of said signal line to the other of said pair of first reference voltages or the other of said pair of second reference voltages according to the value of said most significant bit; and a selective switching circuit including a first through N−1th switches that selectively connect said first through N−1th capacitive elements to said signal lines, respectively, according to values of lower N−1 bits after the discharge by said capacitive element resetting circuit and the resetting by said signal line potential resetting circuit.

10. The driving circuit of an electro-optical device according to claim 9, wherein:

the capacitance of said first through N−1th capacitive elements is set to $C \times 2^{i-1}$ where C is a predetermined unit capacitance, and i is a positive integer between 1 and N−1.

11. The driving circuit of an electro-optical device according to claim 1, wherein the values of said first and second reference voltages are set so that a difference between said driving voltage corresponding to the m−1th gray scale level and said driving voltage corresponding to the m-th gray scale level is smaller than a predetermined value.

12. The driving circuit of an electro-optical device according to claim 11, wherein the values of said first and second reference voltages are set so that a ratio of said optical characteristic where said electro-optical device is driven by said driving voltage corresponding to the m−1th gray scale level to said optical characteristic where said electro-optical device is driven by said driving voltage corresponding to the m-th gray scale level is equivalent to one gray scale level obtained by dividing a variation range of said optical characteristic by $(2^N-1)$.

13. The driving circuit of an electro-optical device according to claim 1, wherein said digital-to-analog converter comprises a resistance ladder that divides said first and second reference voltages, respectively, by a plurality of resistors connected in series.

14. The driving circuit of an electro-optical device according to claim 13, further comprising a selective voltage supply circuit for selectively supplying either said first or second reference voltages to said digital-to-analog converter according to a value of a most significant bit of said digital image signal, and said digital-to-analog converter further comprising:

a decoder that decodes lower N−1 bits of said digital image signal and outputs decoded signals through $2^{N-1}$ output terminals, and $2^{N-1}$ switches, one terminal of each of said $2^{N-1}$ switches connected to each of a plurality of taps from said plurality of resistors and another terminal thereof connected to each of said signal lines, each $2^{N-1}$ switch respectively operated according to the decoded signals output through said $2^{N-1}$ output terminals.

15. The driving circuit of an electro-optical device according to claim 1, wherein said signal lines are provided with predetermined capacitors in addition to a parasitic capacitance of said signal lines.

16. The driving circuit of an electro-optical device according to claim 1, wherein said electro-optical device is a liquid crystal device comprising a liquid crystal held between a pair of substrates, and said driving circuit is formed on one of said substrates.

17. The driving circuit of an electro-optical device according to claim 16, wherein said first and second reference voltages are respectively supplied to said digital-to-analog converter with a voltage polarity with respect to a predetermined reference potential being inverted for each horizontal scanning period.

18. An electro-optical device comprising the driving circuit according to claim 1.

19. Electronic equipment comprising the electro-optical device according to claim 18.

20. The driving circuit of an electro-optical device according to claim 2, wherein at least one pair among a pair of terminals for the first reference voltages and a pair of terminals for the second reference voltages are disposed so that a pair of terminals can be connected to an identical connecting terminal.

21. A driving method of an electro-optical device having a digital-to-analog converter that supplies an analog image signal, which has a driving voltage corresponding to an arbitrary gray scale level among $2^N$ (where N is a natural number) gray scale level, to a signal line of the electro-optical device in which changes in an optical characteristic with respect to changes in said driving voltage are nonlinear, said driving method comprising the steps of:

supplying an N-bit digital image signal indicative of said arbitrary gray scale level to said digital-to-analog converter;

generating a voltage within a range of a first pair of reference voltages or a second pair of reference voltages according to a bit value of said digital image signal to produce said driving voltage corresponding to the gray scale level of said digital image signal so that the changes in said driving voltage with respect to the changes in the gray scale of said digital image signal are nonlinear, wherein the voltage is generated within the range of the pair of first reference voltages if said applied digital image signal indicates a first to m−1th gray scale level (where "m" is a natural number and $1<m\leqq 2^N$) and the voltage is generated within the range of the pair of second reference voltages if said digital image signal indicates an m-th to $2^N$−th gray scale level; and supplying said analog image signal having said generated driving voltage to said signal line.

22. A driving circuit for an electro-optical device, comprising:

an in put interface that receives an input N-bit digital image signal representing a gray scale value in a range of $2^N$ gray scale values (N is a natural number); and a digital-to-analog converter that generates an analog driving voltage corresponding to the input digital image signal, and that supplies the analog driving voltage to a signal line, the digital-to-analog converter simultaneously generating the analog driving voltage for, and performing gamma correction with respect to, the input digital image signal, wherein the digital-to-analog converter generates the analog driving voltage in a first driving voltage range defined by a first pair of reference voltages if the input digital image signal represents a gray scale value from a first to an $m-1^{th}$ value (where m is a natural number and $1<m\leqq 2^N$), and generates the analog driving voltage in a second driving voltage range defined by a second pair of reference voltages if the input digital image signal value represents a gray scale value from an $m^{th}$ to a $2^{Nth}$ value.

23. The driving circuit of an electro-optical device according to claim 22, wherein a voltage polarity of said first pair of reference voltages and a voltage polarity of said second pair of reference voltages supplied to said digital-to-analog converter are set to be opposite from each other so that a change in said driving voltage corresponding to a change in the gray scale has an inflection point between said first and second driving voltage ranges.

24. The driving circuit of an electro-optical device according to claim 22, wherein:

the value of said "m" is equal to $2^{N-1}$;

lower N−1 bits of said digital image signal are selectively applied to said digital-to-analog converter either inverted or non-inverted according to a value of a most significant bit of said digital image signal; and said digital-to-analog converter generates a voltage in the range of said first reference voltage if said lower N−1 bits are non-inverted, and generates a voltage in the range of said second reference voltage if said lower N−1 bits are inverted.

25. The driving circuit of an electro-optical device according to claim 24, further comprising a selective inverting circuit for selectively inverting said lower N−1 bits depending upon the value of said most significant bit, said selective inverting circuit being provided between said interface and said digital-to-analog converter.

26. The driving circuit of an electro-optical device according to claim 22, further comprising a selective voltage supply circuit for selectively supplying either said first or second reference voltages to said digital-to-analog converter according to a value of a most significant bit of said digital image signal.

27. The driving circuit of an electro-optical device according to claim 22, wherein said digital-to-analog converter comprises a switched capacitor type digital-to-analog converter adapted to generate voltages in the ranges of said first and second reference voltages, respectively, by means of charging a plurality of capacitors.

28. The driving circuit of an electro-optical device according to claim 27, wherein said first reference voltages include a pair of voltages that enable a voltage in said first driving voltage range to be selectively generated, and said second reference voltages include a pair of voltages that enable a voltage in said second driving voltage range to be selectively generated.

29. The driving circuit of an electro-optical device according to claim 28, wherein:

the value of said "m" is equal to $2^{N-1}$;

the lower N−1 bits of said digital image signal are selectively applied to said switched capacitor type digital-to-analog converter either inverted or non-inverted before being applied thereto according to a value of a most significant bit of said digital image signal; and said switched capacitor type digital-to-analog converter generates a voltage in the range of said first reference voltages if said lower N−1 bits are applied non-inverted, and generates a voltage in the range of said second reference voltages if said lower N−1 bits are inverted.

30. The driving circuit of an electro-optical device according to claim 27, wherein said switched capacitor type digital-to-analog converter comprises:

a first through an N−1th capacitive elements, each capacitive element respectively having a pair of opposed electrodes, wherein one of said first reference voltages or one of said second reference voltages is selectively applied to one of said opposed electrodes according to a value of a most significant bit of the digital image signal;

a capacitive element resetting circuit for short-circuiting said pair of opposed electrodes in each of said first through N−1th capacitive elements so as to discharge electric charges therein;

a signal line potential resetting circuit for selectively resetting a potential of said signal line to the other of said first reference voltages or the other of said second reference voltages according to the value of said most significant bit; and a selective switching circuit including a first through N−1th switches that selectively connect said first through N−1th capacitive elements to said signal lines, respectively, according to values of lower N−1 bits of the digital image signal after the discharge by said capacitive element resetting circuit and the resetting by said signal line potential resetting circuit.

31. The driving circuit of an electro-optical device according to claim 30, wherein:

the capacitance of said first through N−1th capacitive elements is set to $C \times 2^{i-1}$ where C is a predetermined unit capacitance, and i is a positive integer between 1 and N−1.

32. The driving circuit of an electro-optical device according to claim 22, wherein the values of said first and second reference voltages are set so that a difference between said driving voltage corresponding to the m−1th gray scale level and said driving voltage corresponding to the m-th gray scale level is smaller than a predetermined value.

33. The driving circuit of an electro-optical device according to claim 32, wherein the values of said first and second reference voltages are set so that a ratio of an optical characteristic of said electro-optical device driven by said driving voltage corresponding to the m−1th gray scale level to an optical characteristic of said electro-optical device driven by said driving voltage corresponding to the m-th gray scale level is equivalent to one gray scale level obtained by dividing a variation range of said optical characteristic by $(2^{-1})$.

* * * * *